US011641929B2

(12) United States Patent
Dedewo et al.

(10) Patent No.: US 11,641,929 B2
(45) Date of Patent: May 9, 2023

(54) METHOD AND APPARATUS FOR CUSTOM BLEND COMPOSITIONS

(71) Applicant: ELC MANAGEMENT LLC, Melville, NY (US)

(72) Inventors: Daniel O. Dedewo, Astoria, NY (US); David Edward Wilson, Plainview, NY (US)

(73) Assignee: ELC Management LLC, Melville, NY (US)

( * ) Notice: Subject to any disclaimer, the term of this patent is extended or adjusted under 35 U.S.C. 154(b) by 563 days.

(21) Appl. No.: 16/792,091

(22) Filed: Feb. 14, 2020

(65) Prior Publication Data

US 2020/0260840 A1 Aug. 20, 2020

Related U.S. Application Data

(60) Provisional application No. 62/806,584, filed on Feb. 15, 2019.

(51) Int. Cl.

| | |
|---|---|
| ***A45D 44/00*** | (2006.01) |
| ***G07F 11/72*** | (2006.01) |
| ***B01F 29/10*** | (2022.01) |
| ***B01F 33/84*** | (2022.01) |
| ***B01F 35/71*** | (2022.01) |
| *B01F 101/21* | (2022.01) |

(52) U.S. Cl.

CPC ..... *A45D 44/005* (2013.01); *B01F 29/10* (2022.01); *B01F 33/8442* (2022.01); *B01F 35/7179* (2022.01); *G07F 11/72* (2013.01); *A45D 2044/007* (2013.01); *B01F 2101/21* (2022.01)

(58) Field of Classification Search

CPC ..... A45D 44/005; A45D 2044/007; B01F 35/7179; B01F 29/10; G07F 11/72

See application file for complete search history.

(56) References Cited

U.S. PATENT DOCUMENTS

| | | | |
|---|---|---|---|
| 10,025,280 | B1 | 7/2018 | Bly |
| 2005/0018535 | A1 | 1/2005 | Miller |
| 2005/0092772 | A1 | 5/2005 | Miller et al. |
| 2014/0053950 | A1 | 2/2014 | Vandersteen |

(Continued)

FOREIGN PATENT DOCUMENTS

| | | |
|---|---|---|
| EP | 2272584 A1 | 1/2011 |
| JP | 2007-517541 | 7/2007 |

(Continued)

OTHER PUBLICATIONS

PCT International Search Report; International Application No. PCT/US2020/018440; Completion Date: Jun. 30, 2020; dated Jun. 30, 2020.

(Continued)

*Primary Examiner* — Anshu Bhatia

(74) *Attorney, Agent, or Firm* — Peter Giancana; Tiffany Johnson

(57) ABSTRACT

A cosmetic preparation system may provide a diagnostic or shade matching tool, a dispenser unit, and a mixer unit. The diagnostic or shade matching tool may identify a user skin type and customize one or more ingredients to create a custom blend composition. The dispenser unit may dispense ingredients and prepare the custom blend composition in containers of various sizes. The mixer unit may provide a mixing assembly to mix the one or more ingredients using gyroscopic mixing.

8 Claims, 59 Drawing Sheets

(56) References Cited

U.S. PATENT DOCUMENTS

| | | | |
|---|---|---|---|
| 2014/0116012 | A1 | 5/2014 | Rodrigues |
| 2016/0289058 | A1 | 10/2016 | Foster et al. |
| 2018/0125207 | A1 | 5/2018 | Shami |

FOREIGN PATENT DOCUMENTS

| | | | |
|---|---|---|---|
| JP | 2008-156001 | | 7/2008 |
| JP | 2014-513649 | | 6/2014 |
| JP | 2016-026183 | | 2/2016 |
| WO | WO-2007/110764 | A2 | 10/2007 |
| WO | WO-2015/082917 | | 6/2015 |

OTHER PUBLICATIONS

PCT Written Opinion of the International Searching Authority; International Application No. PCT/US2020/018440; Completion Date: Jun. 30, 2020; dated Jun. 30, 2020.

EP Supplementary Search Report; EP Application No. 20755313.2; Completion Date: Mar. 2, 2022.

102

BACK

ESTĒE LAUDER

YOUR DOUBLE WEAR CUSTOM MATCH™

| CUSTOMER | BEAUTY ADVISOR |
| --- | --- |
| Shade creation and dispense | Statistics, maintenance and dispensing previous products |

FIG. 19

102

BACK

PLEASE ANSWER EACH QUESTION

Question 1 of 5

What is your skin type?

Dry

Normal/Combination

Oily

NEXT

FIG. 21

102

BACK

PLEASE ANSWER EACH QUESTION

Question 2 of 5

What coverage do you want in foundation?

Full

Medium

Light

NEXT

FIG. 22

3502

ESTĒE LAUDER

YOUR DOUBLE WEAR
CUSTOM MATCH™

START BLENDING

FIG. 45

3502

What size of Double Wear are you mixing?

SELECT YOUR SIZE TO BEGIN 10-day Sample

Full-size Bottle

START MIXING

FIG. 46

METHOD AND APPARATUS FOR CUSTOM BLEND COMPOSITIONS

CROSS-REFERENCE TO PRIORITY APPLICATION

This application hereby claims the benefit of U.S. Provisional Patent Application No. 62/806,584 for a "METHOD AND APPARATUS FOR CUSTOM BLEND COMPOSITIONS" (filed Feb. 15, 2019, at the United States Patent and Trademark Office), which is hereby incorporated by reference in its entirety.

FIELD

The present disclosure relates generally to methods and apparatuses for providing custom blend compositions, more particularly, to methods and apparatuses for custom blended cosmetic compositions.

BACKGROUND

Customized or personalized compositions, such as cosmetic compositions, prepared at point of sale are growing in popularity. However, existing methods of preparing such compositions can suffer from various challenges and inefficiencies. For example, existing methods can fail to provide various sample sizes ranging from single-use dosages to full, saleable sizes. Furthermore, some existing methods can provide uneven mixing of components within a composition. Additionally, existing methods and apparatuses can cause ink to become unstable due to temperature and mixing inadequacies. Existing methods and apparatuses can have prolonged exposure to air from exposed nozzles and/or canisters containing cosmetic compositions, and the nozzles and/or canisters can become contaminated. As such, there is a need for an improved process to mix custom compositions or cosmetic products at a point of sale.

SUMMARY

Embodiments herein provide systems and methods for custom blend compositions using a diagnostic or shade matching tool, a dispenser unit, and a mixer unit.

In one embodiment, the dispenser unit includes a dispensing assembly configured to dispense various sizes including single-dose samples and full-size samples.

In an embodiment, the mixer unit includes a mixing platform includes gyroscopic mixing configured to rotate off-center relative to the center of mass.

The dispenser unit and unit can be configured to interact with one another, and with one or more external devices, databases, and servers.

DESCRIPTION OF THE DRAWINGS

FIG. 18-FIG. 33 show exemplary displays shown on a screen of a user interface of the dispenser unit of FIG. 1, according to an embodiment of the present disclosure;

FIG. 44-FIG. 47 shows an exemplary display shown on a screen of a user interface of the mixing unit of FIG. 34, according to an embodiment of the present disclosure;

DETAILED DESCRIPTION

Embodiments of the present disclosure are described herein with reference to exemplary dispensing, mixing, and computing system architectures. It is to be understood, however, that embodiments of the present disclosure are not intended to be limited to these exemplary architectures but are rather more generally applicable to any systems where customized compositions may be desired.

As used herein, "n" may denote any quantity greater than one.

Figure 1:
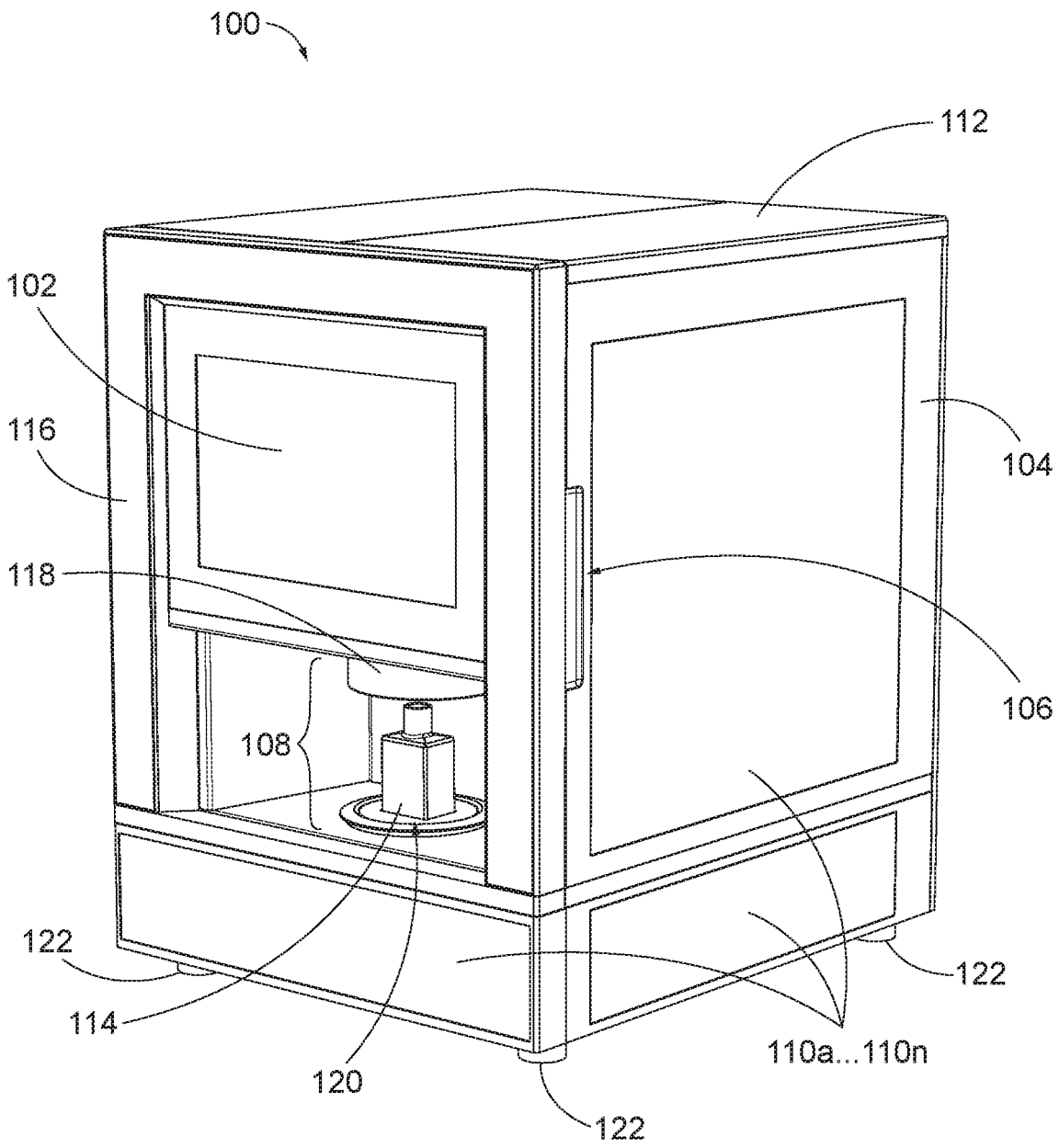
FIG. 1 depicts a perspective view of at dispenser unit for dispensing one or more cosmetic ingredients and/or compositions according to embodiments herein.

Referring to FIG. 1, dispenser unit 100 includes a front door panel 116 having a dispenser interface 102 for interacting with one or more users, according to an embodiment of the present disclosure. Backlit panels may be provided on the device and may draw attention to the units including, but not limited to, advertisements, interactive demonstrations, and other visual displays. Dispenser unit 100 includes a side door 104 that may provide a door handle 106 for access to internal machinery/cavity of the dispenser unit 100. Dispenser unit 100 may also include a dispensing assembly 108, which may include a dispenser head 118 for dispensing one or more ingredients and/or composition into a container 114, and a container guide 120 for proper or custom positioning of the container 114. Container 114 may be a bottle, a tube, a jar, or another form of a container. Dispenser unit 100 may also include a storage compartment 112 for storing various items, such as diagnostic devices or tools. Dispenser unit 100 may include point of sale ("POS") displays 110*a* . . . 110*n* at various locations on the dispenser unit body for displaying advertisements, instructions, and/or other graphics. POS displays 110*a* . . . 110*n* are configured to be interchangeable displays. For example, the POS displays 110*a* . . . 110*n* may be positioned in recesses in various portions of the dispenser unit 100 configured to receive magnetized graphics, thereby facilitating change of graphics when needed or desired. In some embodiments, the POS displays 110*a* . . . 110*n* may be different electronic screens arranged to display different graphics. It should be appreciated that screen sharing may be provided without departing from the present disclosure. Details of each of the components of dispenser unit 100 are delineated below.

Figure 2:
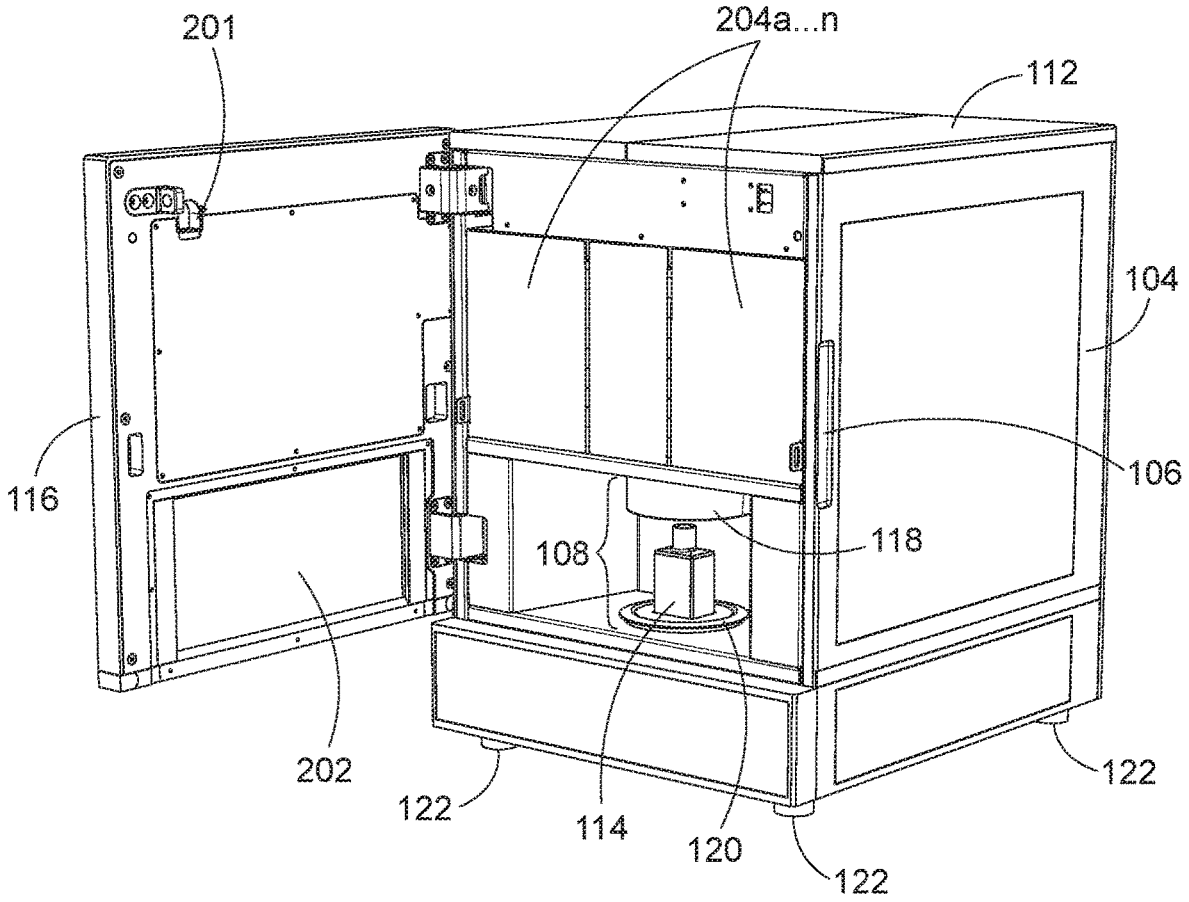
FIG. 2 depicts a front perspective view of the dispenser unit of FIG. 1 with the door panel in an open configuration, according to an embodiment of the present disclosure.

FIG. 2 depicts the dispenser unit 100 (FIG. 1) with the front door panel 116 in an open position, according to an embodiment of the present disclosure. Front door panel 116 may include a protective screen 202 positioned in front of the dispensing assembly 108. Front door panel 116 also includes screen power button 201 for powering the dispenser interface 102. Front door panel 116 may provide clearance to open without striking the bottle or container when placed in front of the front door panel 116. Above the dispensing assembly 108, storage 204*a* . . . 204*n* may be arranged for one or more packs (e.g., packs of colorants, ingredients compositions, and other materials or ingredients).

Figure 3:
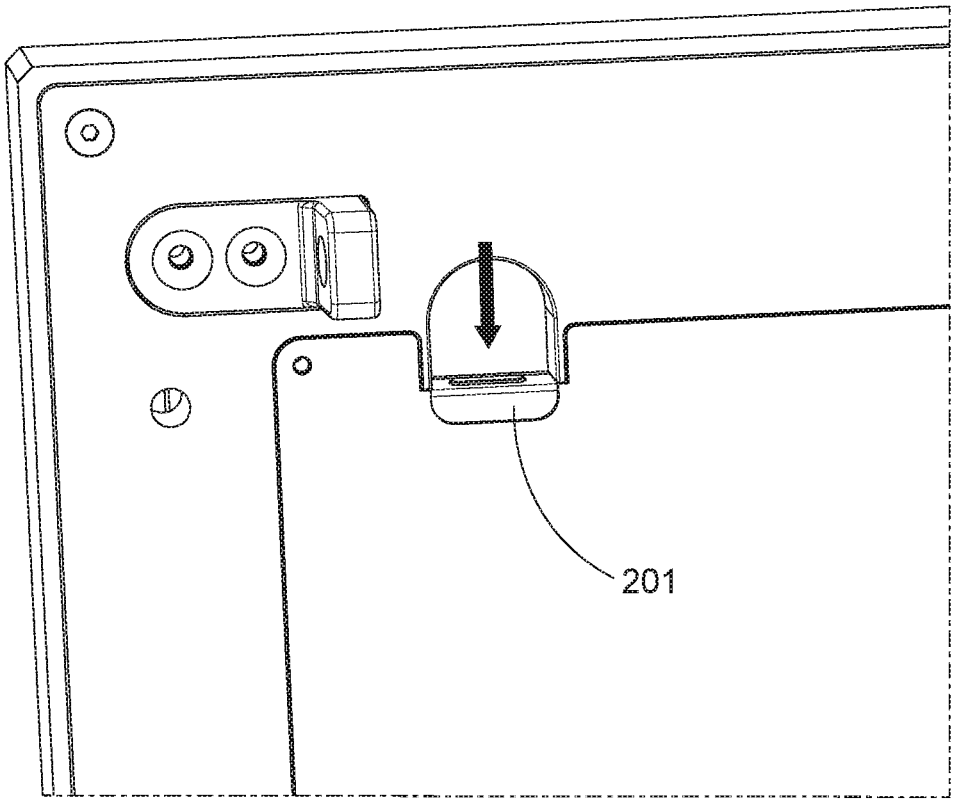
FIG. 3 depicts a partial view of the door panel of the dispenser unit of FIG. 1, according to an embodiment of the present disclosure.

FIG. 3 depicts an enlarged partial view of the front door panel 116 (FIG. 2) showing the screen power button 201, according to an embodiment of the present disclosure. Other configurations and types of controls may be utilized for operating dispenser interface 102 (FIG. 1).

Figure 4:
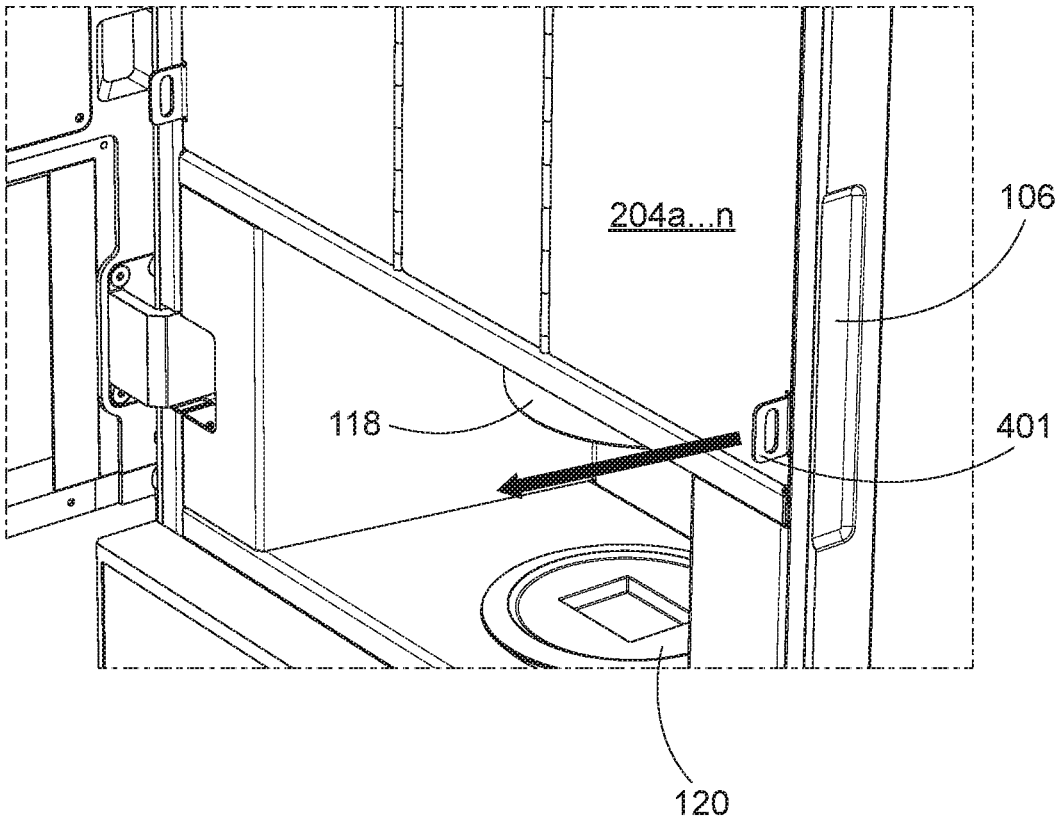
FIG. 4 depicts a partial view of storage compartments of the dispenses unit of FIG. 1, according to an embodiment of the present disclosure.

FIG. 4 depicts an enlarged view of storage 204*a* . . . 204*n* for various materials capable of being dispensed by the dispenser unit 100, according to an embodiment of the present disclosure. Each storage 204*a* . . . 204*n* may include a single material or more than one material. The material may include, but is not limited to, a base formulation for a skincare treatment, makeup product or hair care product, color extenders, active ingredients, sunscreen, fragrance, and other materials. It should be appreciated that the material may be a cosmetic preparation that may be intended for use on any keratinous surface(s). Storage 204*a* . . . 204*n* may include one or more pull tabs 401 for opening and closing one or more of the storage panel door of storage 204*a* . . . 204*n*.

Figure 5:
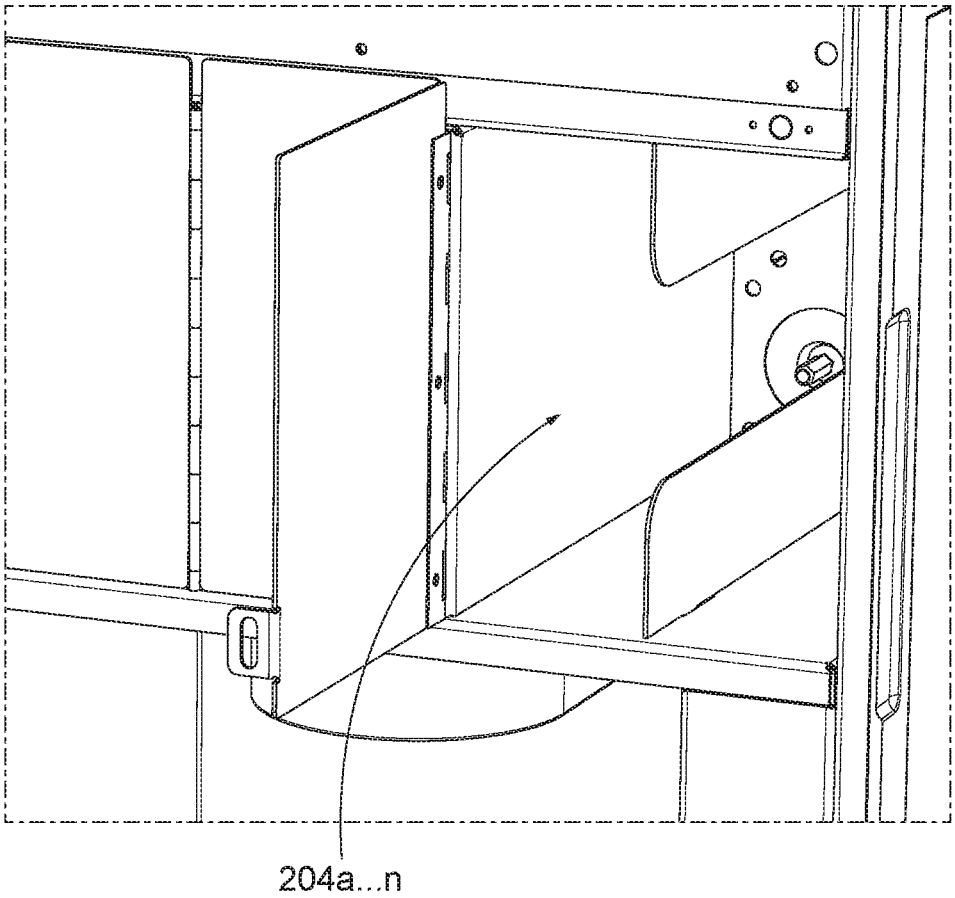
FIG. 5 depicts a partial view of packs being placed into the storage compartments of FIG. 4, according to an embodiment of the present disclosure.

FIG. 5 depicts an enlarged view of one of storage 204*a* . . . 204*n* in an open position showing the inner cavity in which material may be placed, according to an embodiment of the present disclosure. A method of inserting the material packs into the cavity may include sliding the pack in slowly and firmly. Each storage 204*a* . . . 204*n* may include motors for controlling the dispensing of the material in each pack. The slowly spinning motor allows the hex drive to align.

Figure 6A:
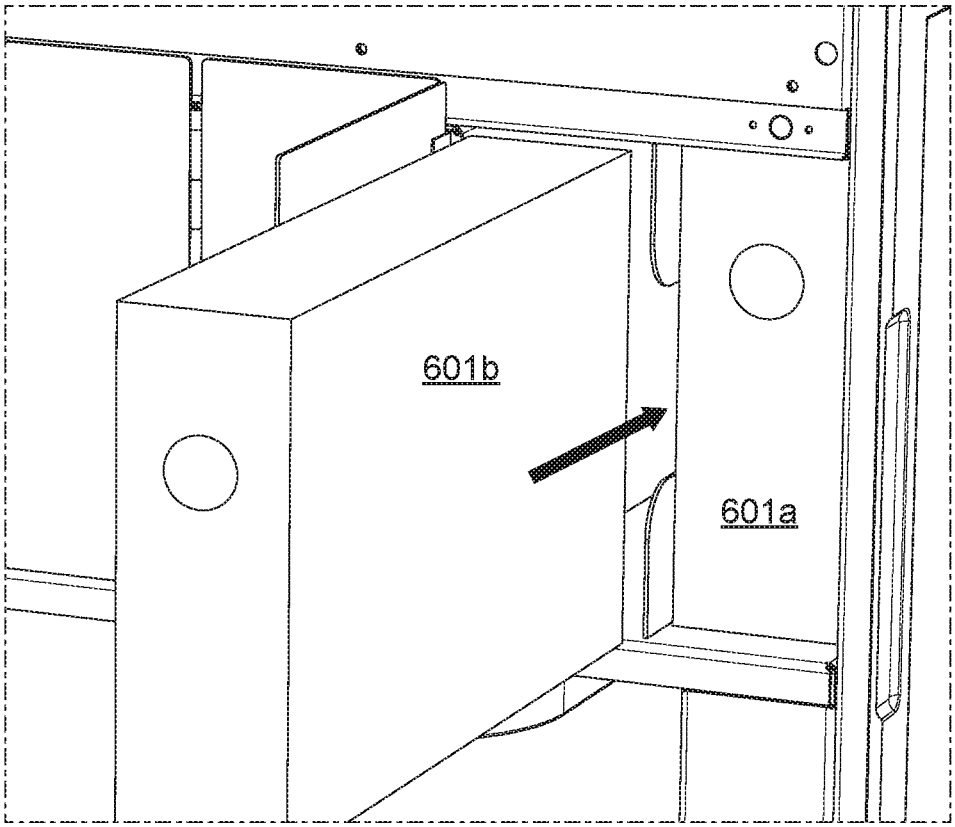
FIG. 6A depicts a partial view of the packs being placed in the storage compartments of FIGS. 4 and 5, according to an embodiment of the present disclosure.
Figure 6B:
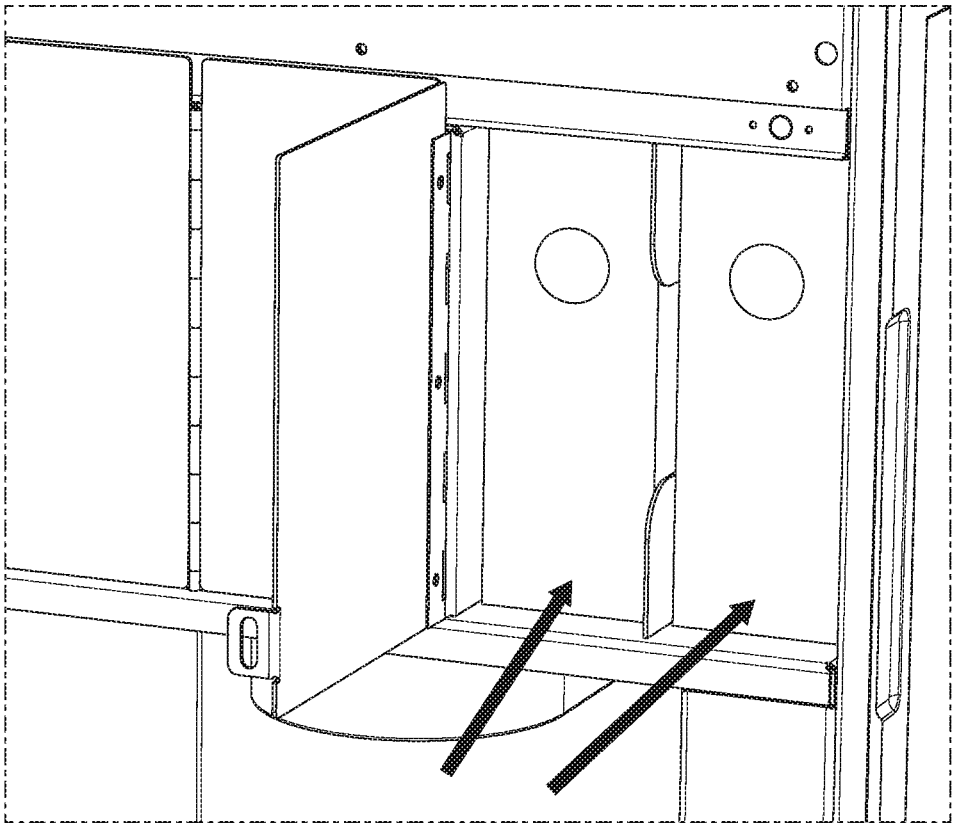
FIG. 6B depicts a partial view of the packs in proper storage configuration in the storage compartments of FIGS. 4 and 5, according to an embodiment of the present disclosure.

FIG. 6A depicts exemplary one or more material packs 601*a* . . . 601*n*. Material packs 601*a* . . . 601*n* may be in any suitable form, for example, boxes, bags, bag-in-boxes, cartons, etc. For example, as shown, a material pack 601*a* is in the cavity of a storage 204*a* and material pack 601*b* in the process of being placed into the cavity of storage 204*a*. FIG. 6B depicts the material packs 601*a* and 601*b* of FIG. 6A in proper alignment within storage 204*a*. The doors on storage 204*a* conceal the material packs 601*a* and 601*b* and reassure the user that the packs are fully inserted. The front door panel 116 may not fully close, unless the doors on storage 204*a* are fully closed.

Figure 7:
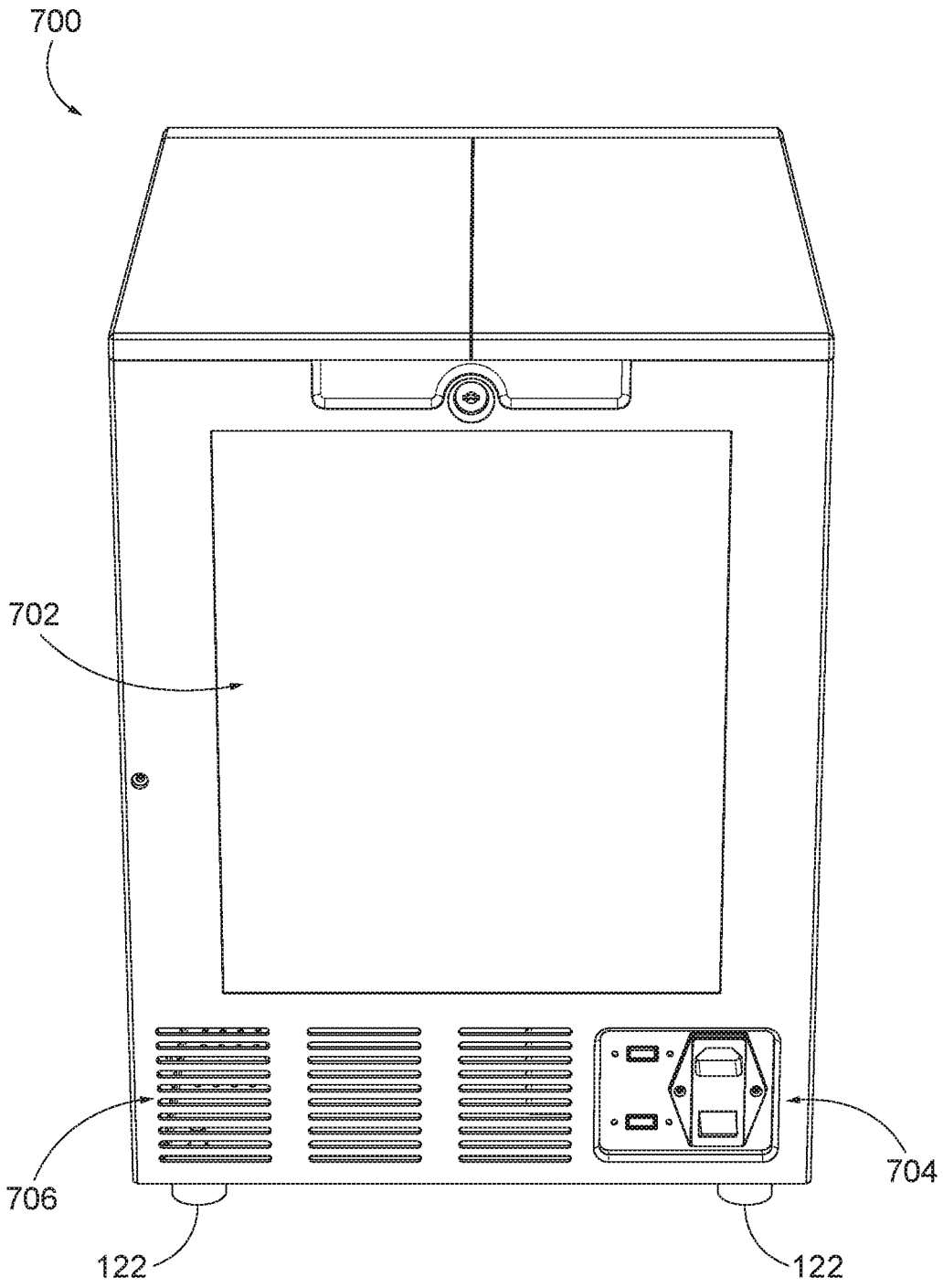
FIG. 7 depicts a rear perspective view of the dispenser unit of FIG. 1, according to an embodiment of the present disclosure.

FIG. 7 depicts a rear perspective view of the dispenser unit 100, according to an embodiment of the present disclosure. Shown in FIG. 7 are rear panel 702, an input/output panel 704, and vents 706. Each of these elements are further delineated below.

Figure 8:
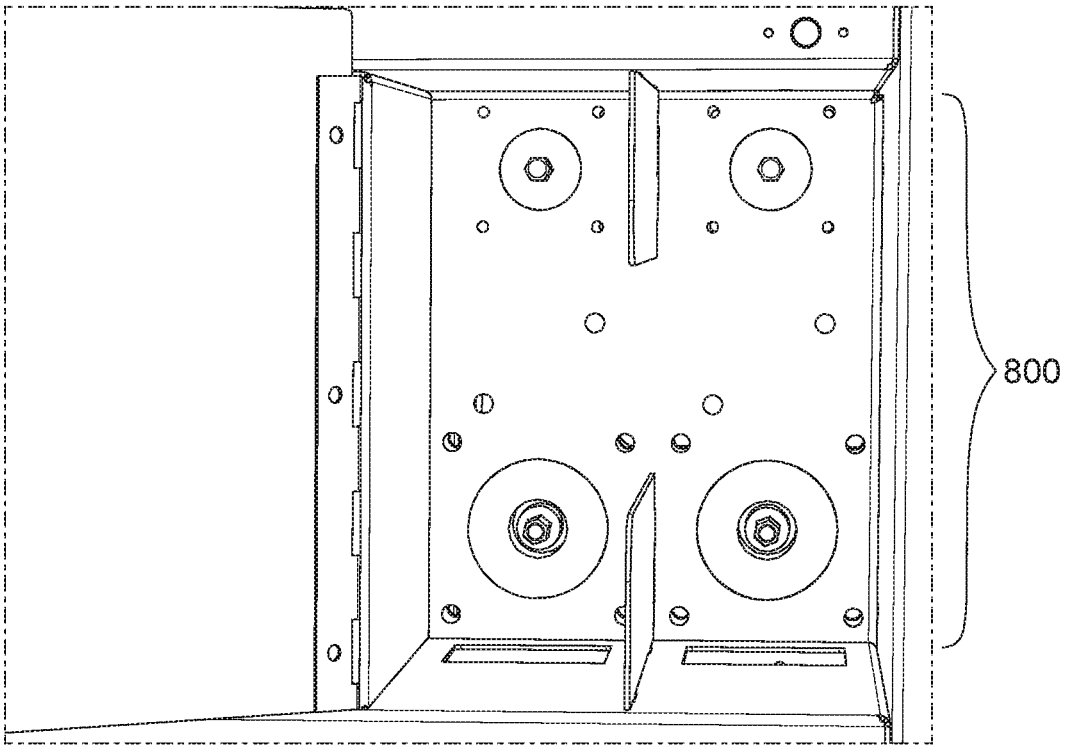
FIG. 8 depicts a partial view of an engine compartment of the dispenser unit of FIG. 1, according to an embodiment of the present disclosure.

FIG. 8 depicts an enlarged view of the engine 800 configured to move the material in one or more of storage 204*a* . . . 204*n* through the dispenser unit 100, according to an embodiment of the present disclosure. In certain embodiments, one engine 800 may be utilized in the dispenser unit 100. In some embodiments, each storage 204*a* . . . 204*n* may have a separate engine 800 for use in moving the materials in the material packs 601*a* . . . 601*n*.

Figure 9:
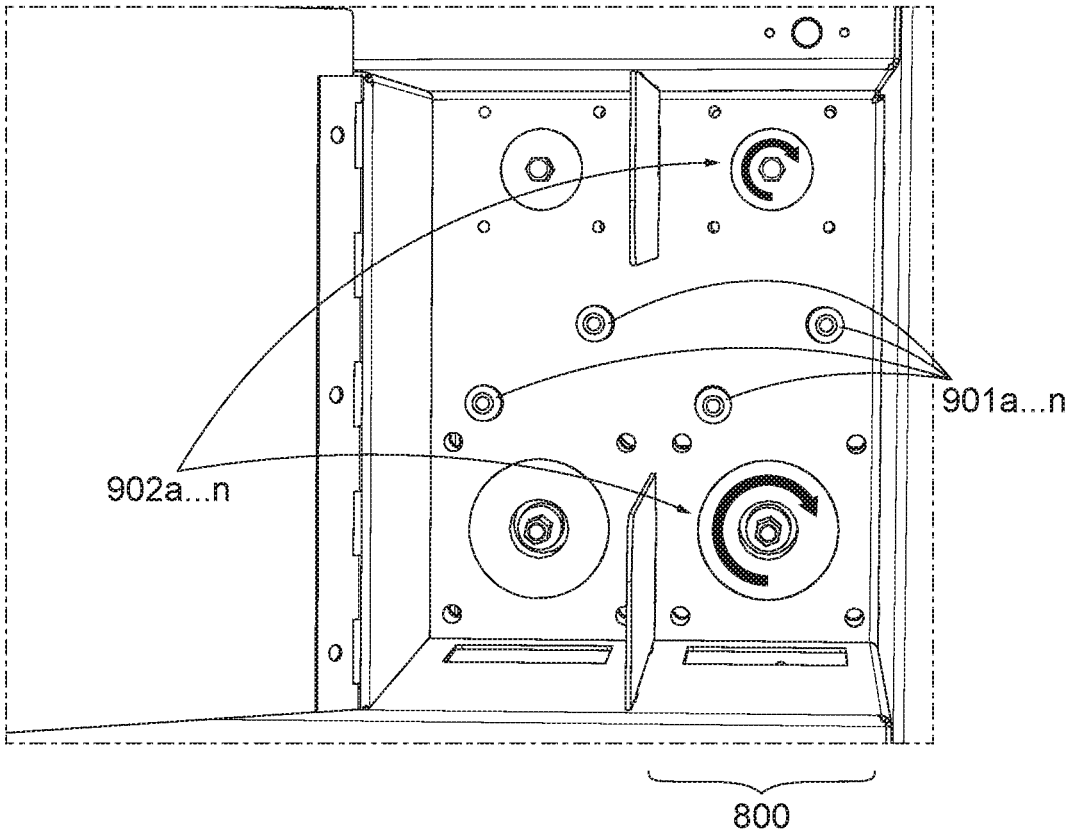
FIG. 9 depicts inlet nozzles and motors of the engine compartment of FIG. 8, according to an embodiment of the present disclosure.

As shown in FIG. 9, the engine 800 may include one or more inlet nozzles 901*a* . . . 901*n* and motors 902*a* . . . 902*n*, according to an embodiment of the present disclosure. The inlet nozzles 901*a* . . . 901*n* may be connected to the material packs 601*a* . . . 601*n* via tubes to transfer the materials from storage 204*a* . . . 204*n* to the dispenser head 108 of the dispenser unit 100. Motors 902*a* . . . 902*n* may slowly spin when the material packs 601*a* . . . 601*n* are loaded into the storage 204*a* . . . 204*n*. Motors 902*a* . . . 902*n* may allow movement of content of the material packs throughout the dispenser unit 100. Further, motors 902*a* . . . 902*n* may be connected to high flow pumps, intermediate flow pumps, low flow pumps, and/or combinations thereof to allow for precise dispensing of the materials without sacrificing speed of dispense. For example, the motors may be configured to dispense at a rate as low as 1 milligram (mg) to 4 mg per drop. Each pump may be in fluid connection with the pack and the nozzle tip independently. Each nozzle tip and pack may have at least one pump connected thereto. A user (e.g., machine administrator) may control the engine settings, including the nozzle and motor settings by utilizing the dispenser interface 102 on the dispenser unit. For example, to monitor the level of materials in each material pack or control the dispensing speed. While not shown, a camera may be configured in the interior of the dispenser unit 100 (e.g., in one or more of storage 204*a* . . . 204*n*, dispenser assembly 108, or another component of dispenser unit 100) to record and stream the progress of the material pack contents, as contents travel through the dispenser unit 100 to the container 114. The data from the camera may be sent to one or more devices for viewing, for example, to the dispenser interface 102 or a mobile device.

Figure 10:
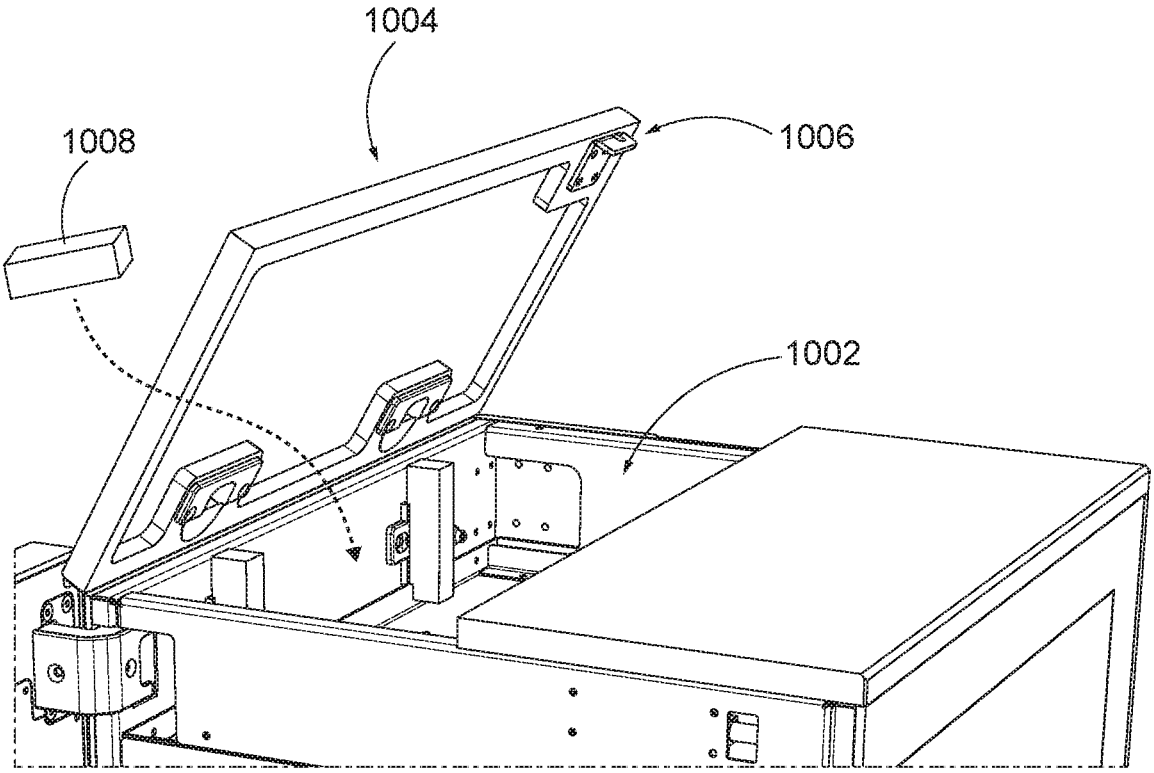
FIG. 10 depicts a partial view of a top storage container of the dispenser unit of FIG. 1 in an open position, according to an embodiment of the present disclosure.

FIG. 10 depicts a partial view of a storage container 1002 of dispenser unit 100. The storage container 1002 may include a container door 1004 and an interior element 1006 of the storage door locking mechanism, according to an embodiment of the present disclosure. Storage container door 1004 may provide a soft closing to prevent injury to the user. The storage container 1002 may incorporate hidden hinges to allow complete closing of the storage container door 1004 without a visible bearing surface. Storage container 1002 may be utilized to store items including, but not limited to, a diagnostic tool 1008 for use in evaluating consumer needs, such as skin shade for recommending or customizing a makeup product (e.g., foundation), or evaluating consumer skin type for customizing or recommending skin care products It should be appreciated that shade is defined as any type of shade including, but not limited to, skin shade, hair shade or color, nail shade or color, and other compositions having different colors, textures, and/or varying properties.

Figure 11:
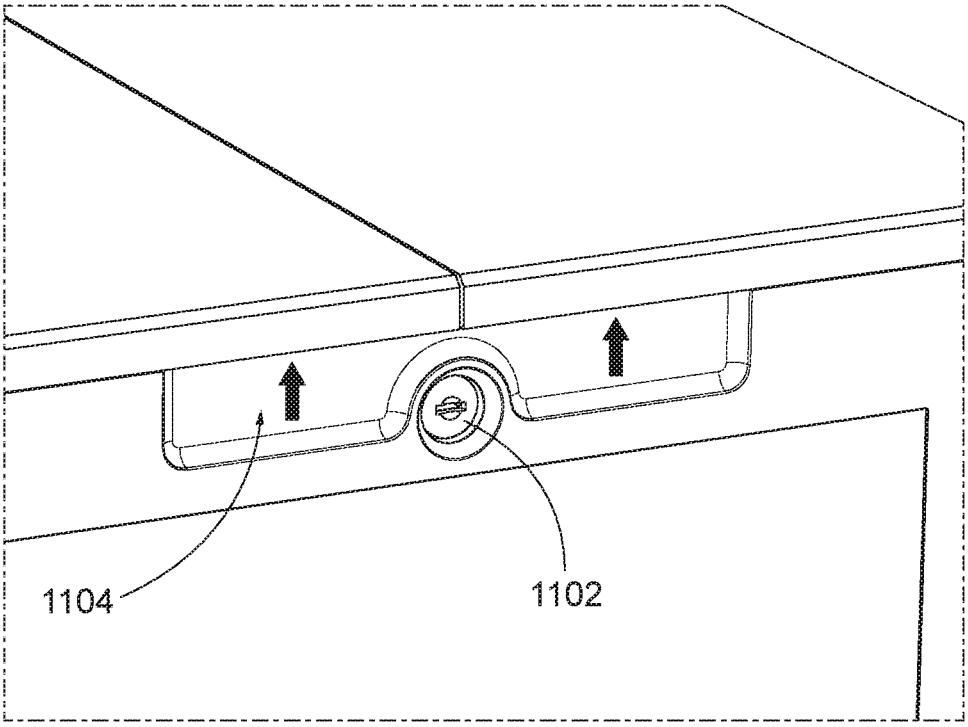
FIG. 11 depicts a partial view of a locking mechanism for the storage container of FIG. 10, according to an embodiment of the present disclosure.

FIG. 11 depicts an enlarged view of the exterior element 1102 of the storage container locking mechanism, which may be coupled with the interior element 1006 to provide a locking feature for the storage container 1002 of FIG. 10, according to an embodiment of the present disclosure. Storage container 1002 may include one or more door handles 1104 for accessing the storage container 1002.

Figure 12:
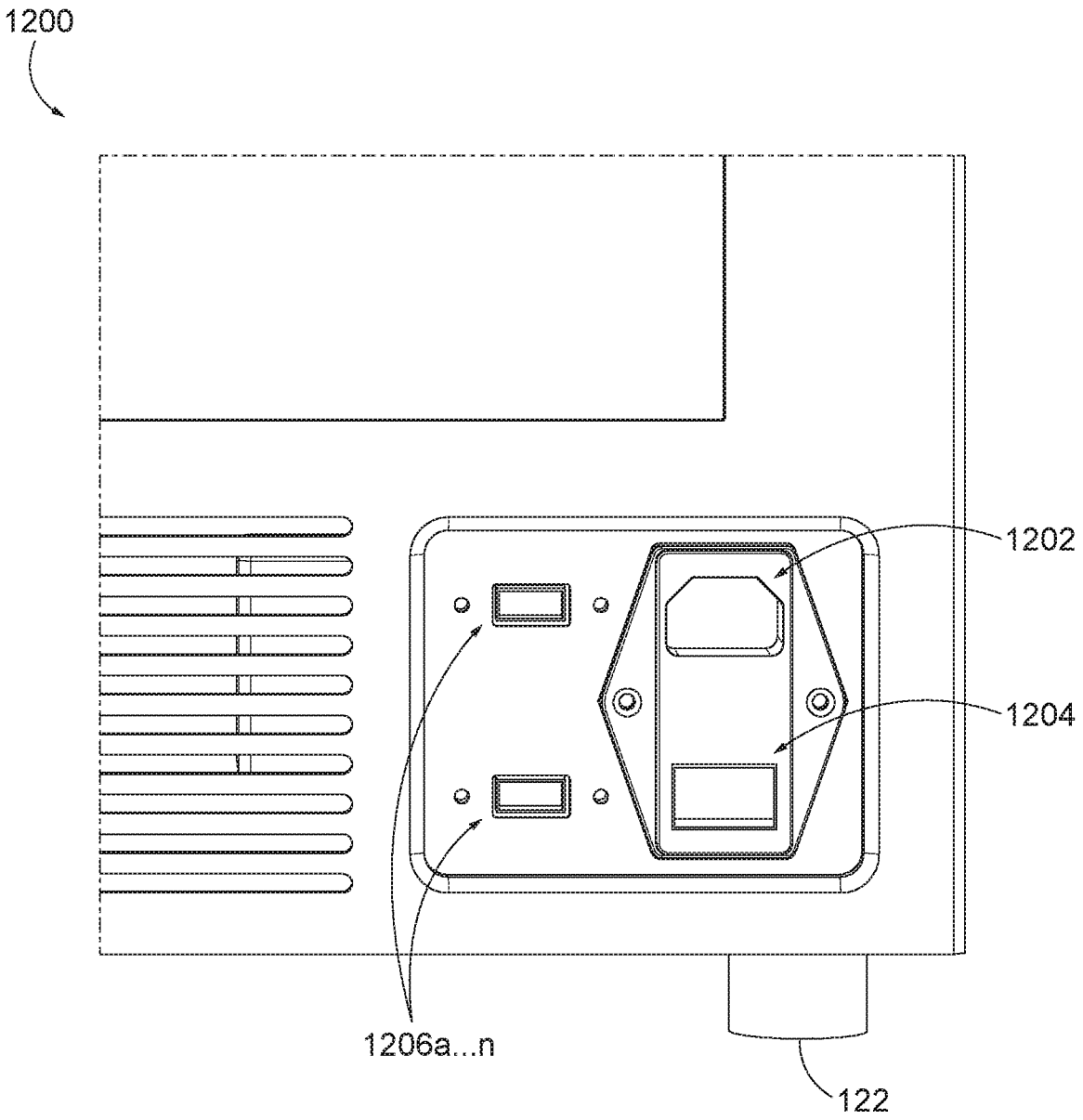
FIG. 12 depicts a partial view of a panel for external inputs and/or outputs for the dispenser unit of FIG. 1, according to an embodiment of the present disclosure.

FIG. 12 depicts a panel for external inputs and/or outputs 704 for the dispenser unit 100, according to an embodiment of the present disclosure. External inputs and/or outputs panel 704 may include an International Electrotechnical Commission ("IEC") socket 1202 for connecting power supply cords to the dispenser unit 100, a power switch 1204 for powering the dispenser unit 100 on or off, and one or more USB or Ethernet outlets 1206*a* . . . 1206*n* for connection to various devices for data input/output (e.g., printing, machine diagnostics, software update, etc.). All wiring external to the unit may be removable for ease of transporting.

There may be stabilizing mechanisms or feet 122 arranged or affixed underneath the units that may reduce vibration. Stabilizing mechanisms or feet 122 may enable leveling of the units on any counter or surface. An alternative embodiment is a tripod leveling system with one fixed tripod in the rear and two adjustable tripods in the front corners.

There may be an air control system for dust and odor migration. The system may have negative air filtration, for pulling air or odor through a charcoal filter and positive air filtration, for drawing air through a filter in order to keep dust out of the units.

Figure 13:
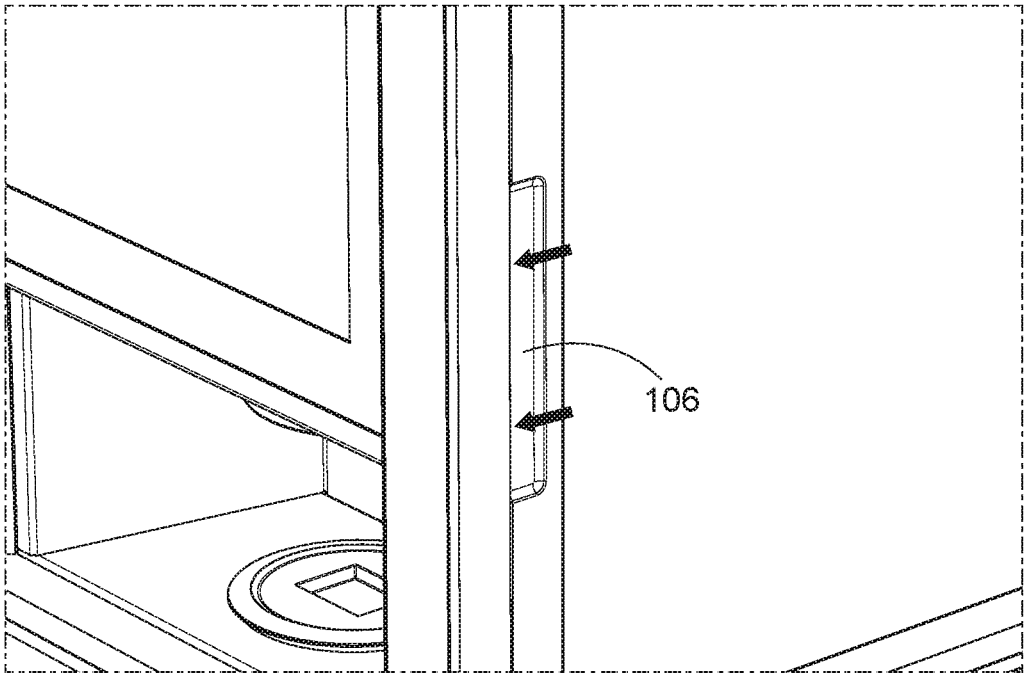
FIG. 13 depicts a partial view of a side door panel of the dispenser unit of FIG. 1, according to an embodiment of the present disclosure.

FIG. 13 depicts an enlarged view of the door handle 106 of side door 104, according to an embodiment of the present disclosure. Door handle 106 may provide a recessed area to enable finger purchases and ease of door opening, without the need for any extrusions that may compromise flat and flush walls of the device. As a safety feature, the dispenser unit 100 may be configured to cease operation when the side door 104 is opened. Side door 104 may be a magnetic interlock or other locking mechanisms.

Figure 14:
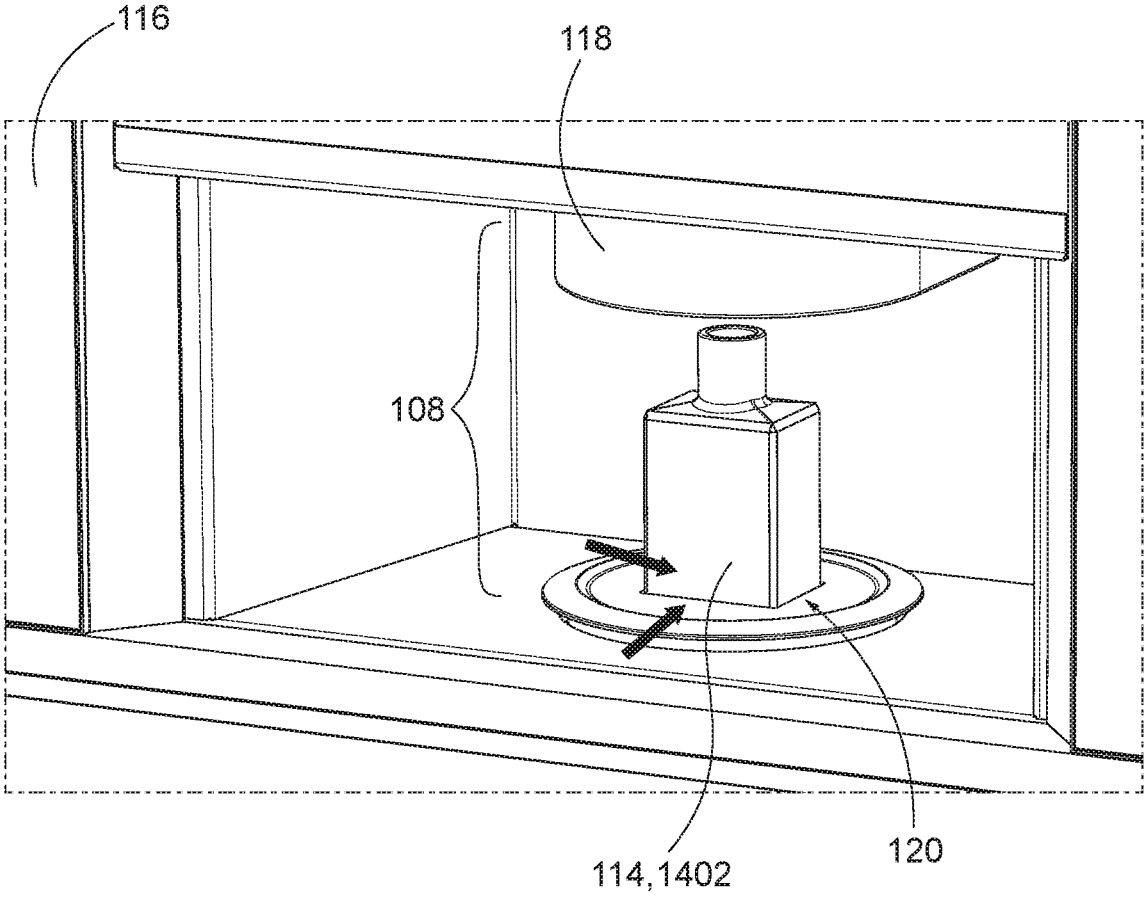
FIG. 14 depicts a partial view of a dispenser head and component guide of the dispenser unit of FIG. 1, according to an embodiment of the present disclosure.

FIG. 14 depicts an enlarged view of the dispensing assembly 108, according to an embodiment of the present disclosure. The dispensing assembly 108 may include a dispenser head 118 configured to dispense material into a container 114, which may be a bottle 1402, and a into a container guide 120. Bottle 1402 may be positioned such that it is secure and centrally located on the container guide 120 to receive material from the dispenser head 118. In an alternative embodiment, the dispensing assembly may have two moveable yokes to center the neck finish of the bottle 1402 underneath the nozzle head 1604. Container guide 120 may be a "scale coupling" that may be designed to connect directly to the scale or weight measuring system below. Container guide 120 may also have a flanged edge to overlap the aperture to the weight measuring system and prevent dust and debris from entering dispenser unit 100. Container guide 120 may have a front opening that may restrain the bottle 1402 on three sides to allow the bottle to easily slide out. It should be appreciated that the container guide 120 may retrain the bottle on less than or greater than three sides without departing from the present disclosure.

Figure 15:
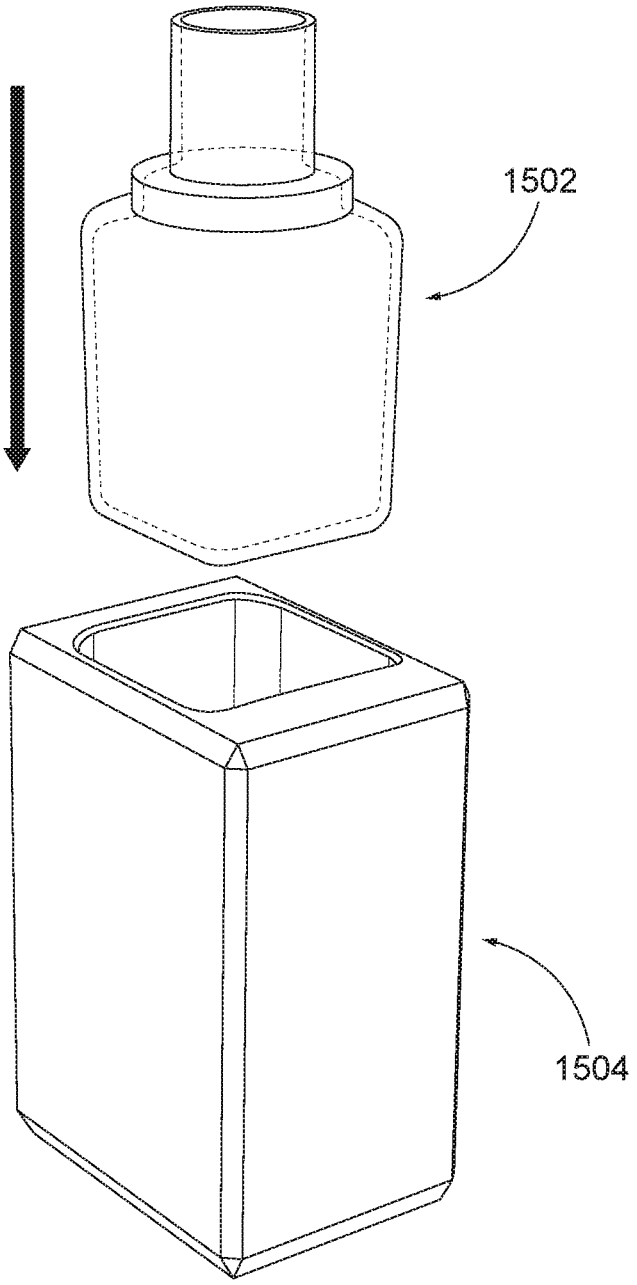
FIG. 15 depicts an exploded view of an exemplary bottle and bottle sleeve for use with the dispenser unit of FIG. 1, according to an embodiment of the present disclosure.

As shown in FIG. 15, the bottle 1502 may be placed into a bottle sleeve 1504 for protection and fit, according to an embodiment of the present disclosure. For example, the bottle 1502 may be a small sample bottle and the bottle sleeve 1504 serves to secure the bottle 1502 on the container guide 120 and elevate the bottle 1502 towards the nozzle head. It should be appreciated that there may be a standard format for these units. Bottle sleeve 1504 may allow for multiple sized packaging to be filled and utilized. Bottle sleeve 1504 may adjust to correspond to the exterior size of the parent shape or standard format.

Figure 16:
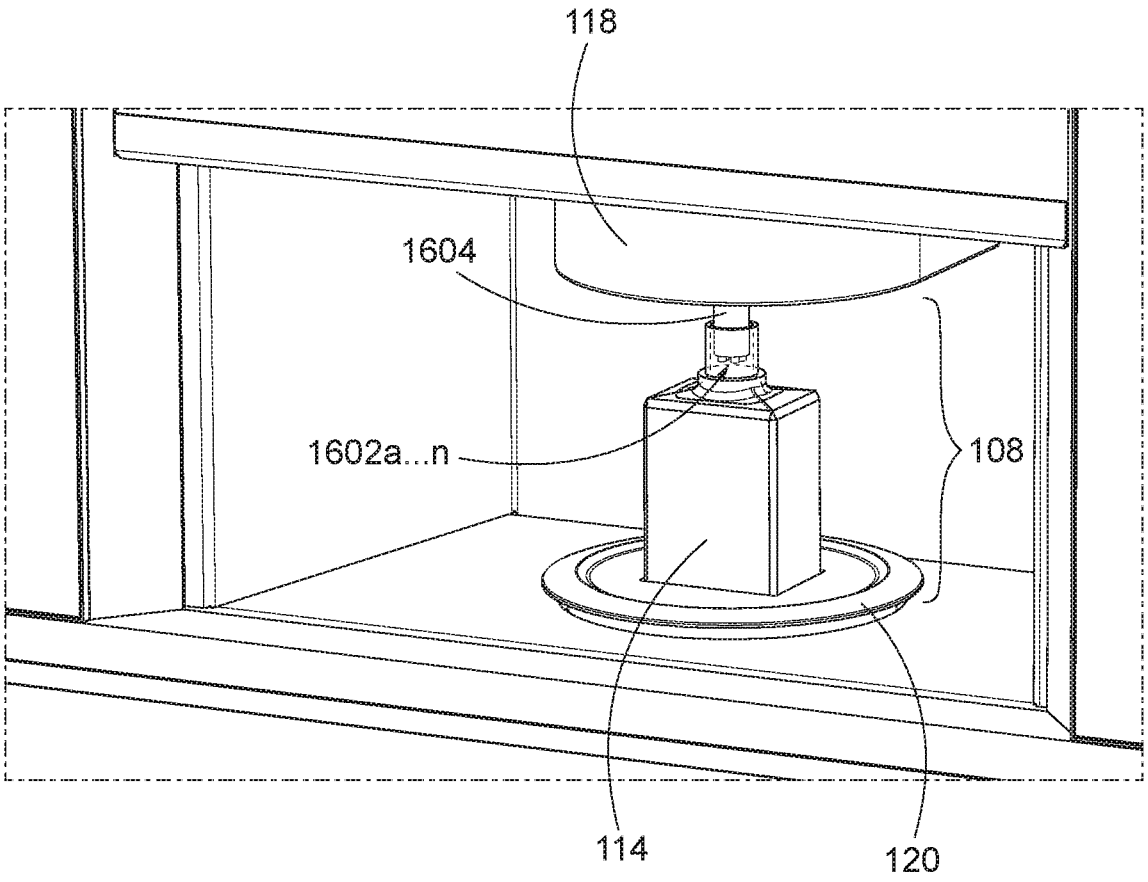
FIG. 16 depicts a partial view of the bottle and bottle sleeve positioned at the component guide and nozzle head of FIG. 14, according to an embodiment of the present disclosure.

As shown in FIG. 16, the nozzle assembly includes at least one nozzle 1602*a* . . . 1602*n* and a nozzle limit switch 1606, according to an embodiment of the present disclosure. Materials and or compositions may be dispensed from the nozzle head 160 via one or more nozzles 1602*a* . . . 1602*n* shown in FIG. 16. Nozzle limit switch 1704 may be configured to regulate and control operations of the nozzles. For example, when the nozzles 1602*a* . . . 1602*n* are lowered towards a container, if the nozzle assembly contacts the container because of misalignment, the limit switch may stop the nozzle assembly from going any further to prevent damage to the nozzles. The nozzle diving depth may ideally be arranged to the base of the "H" dimension to avoid misalignment and damage to the nozzle. This arrangement may minimize the travel distance of the driving nozzle. The clearance between the nozzle dispenser head 118 and the container guide 120 may be sufficient to allow the bottle 1502 to be inserted into or removed from dispenser tint 100 without striking the dispenser head 118 or spilling in the dispenser chamber when it is removed. It should be appreciated that the ideal distance between the dispenser head 118 and the top of the bottle neck 1502 is ¼ inch. It should also be appreciated that the distance may be less than or greater than ¼ inch without departing from the present disclosure. It should further be appreciated that the ideal distance may prevent the bottle or container from unexpectedly flipping over or turning.

Figure 17A:
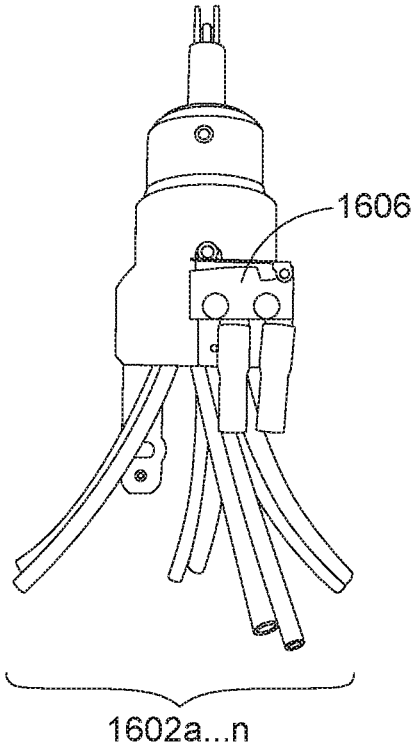
FIG. 17A show a perspective view of the nozzle head and nozzles of FIG. 16, according to an embodiment of the present disclosure.
Figure 17B:
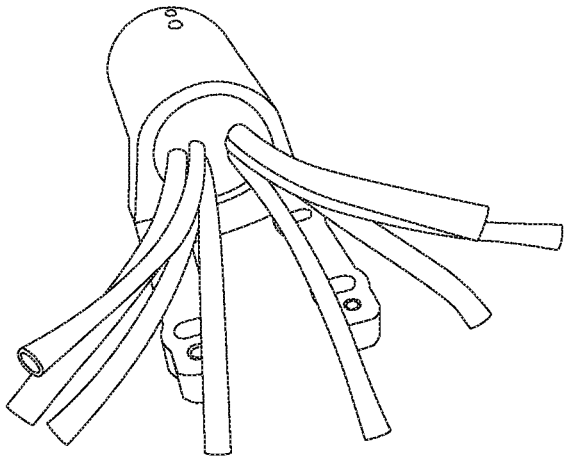
FIG. 17B is a bottom view of the nozzle head and nozzles of FIG. 17A, according to an embodiment of the present disclosure.
Figure 17C:
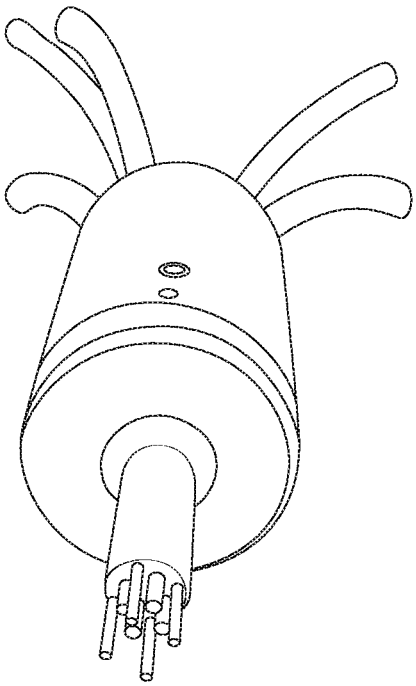
FIG. 17C is a top view of the nozzle head and nozzles of FIG. 17A, according to an embodiment of the present disclosure.

FIGS. 17A, 17B, and 17C depict a front perspective view, a bottom view, and a top view, respectively, of the nozzle head assembly, according to an embodiment of the present disclosure. As shown in FIGS. 17A-17C, the nozzle head assembly includes one or more nozzles 1602*a* . . . 1602*n* and a nozzle limit switch 1606. The surface energy may allow droplets to have a larger diameter than that of the nozzle itself. The smaller the diameter of the nozzle, the greater the potential of differential between the droplet diameter and the diameter of the nozzle. For this reason, bridging of the product may occur between each nozzle during and after dispensing. Bridging may cause cross contamination of products, and as a result, bridging may compromise the integrity and precision of the end-product. Bridging may cause the nozzles to become dirty and require frequent maintenance. To prevent or greatly minimize these events, the needle nozzles within the nozzle head 1604 may be positioned at different heights and the spacing between the nozzles may be based on the rheology of the product being dispensed. The spacing between nozzles must be at least 1.5× the diameter of the largest droplet that can be formed out of said nozzle.

Figure 18:
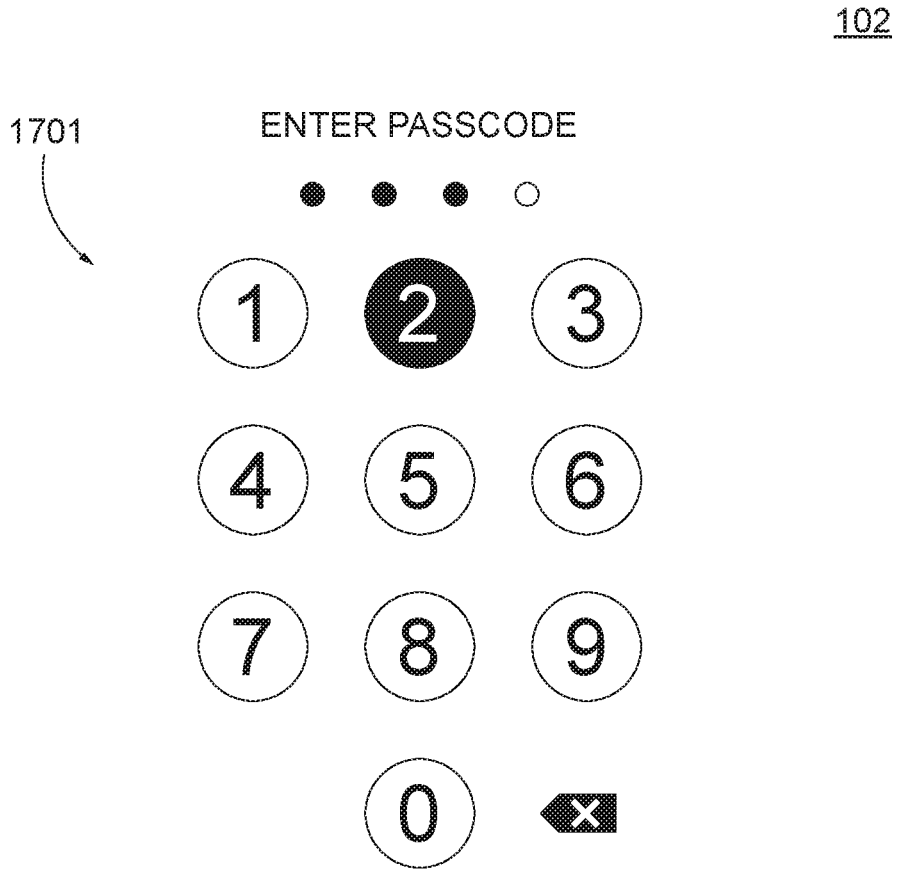
Figure 20:
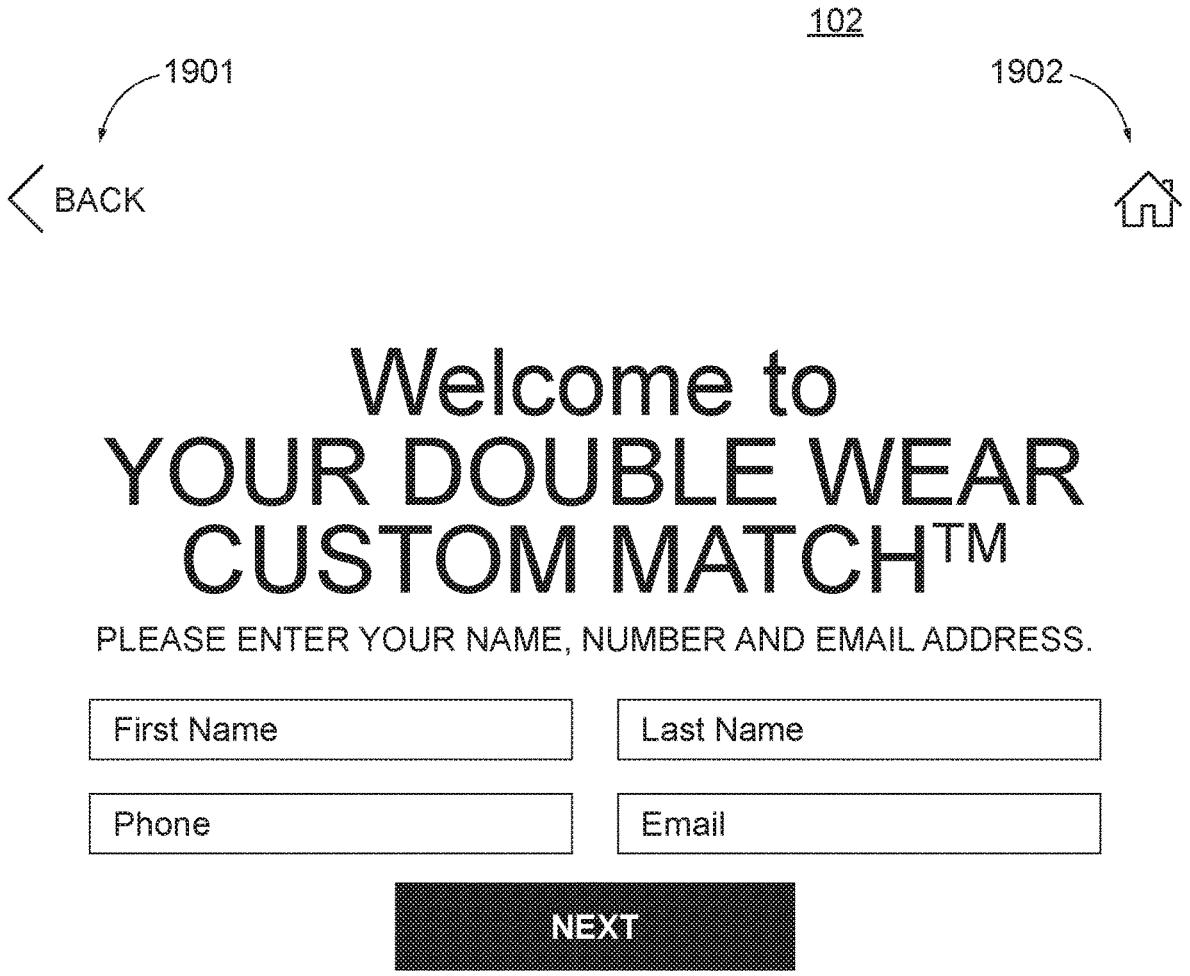
Figure 23:
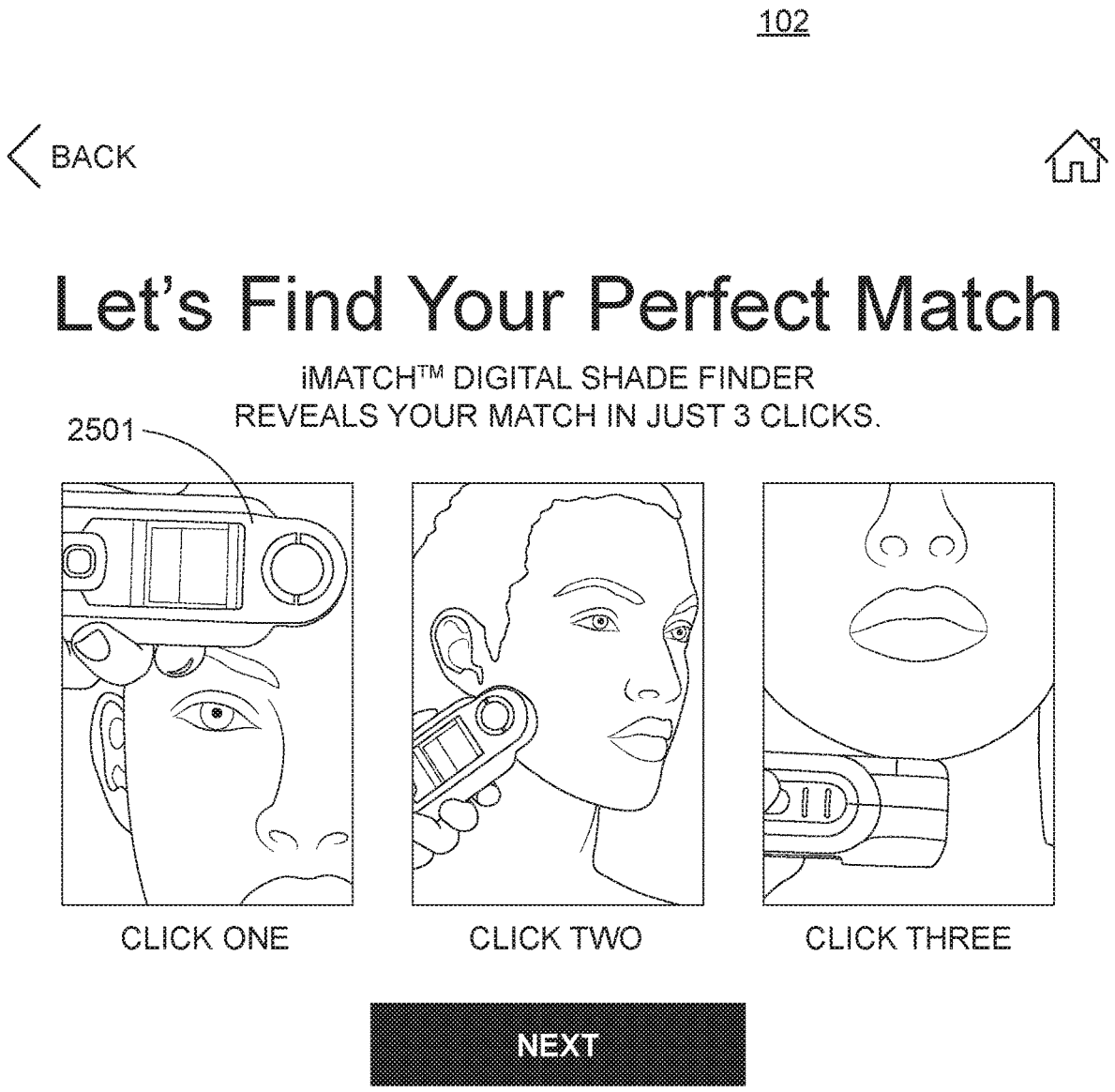
Figure 24:
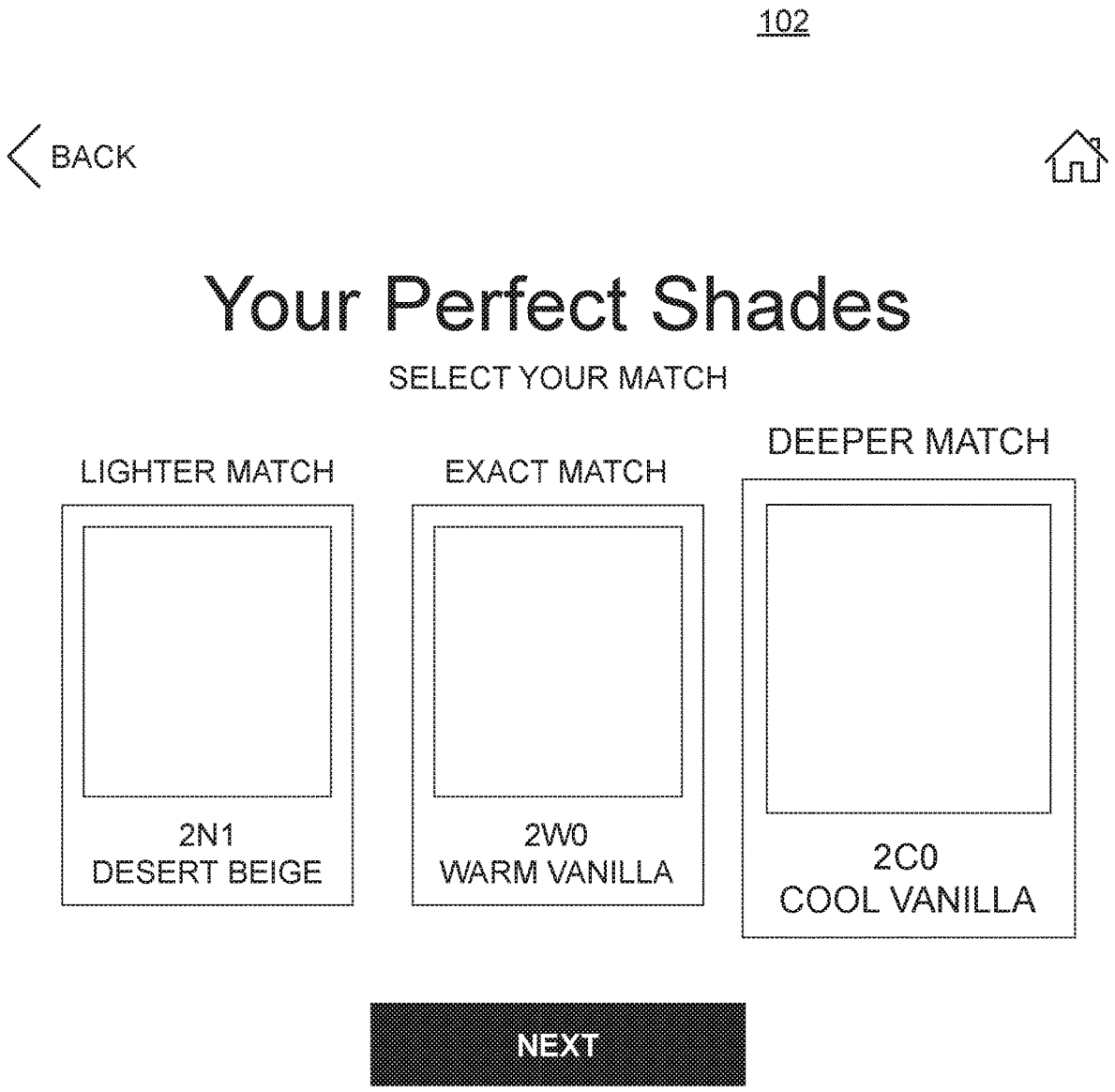
Figure 25:
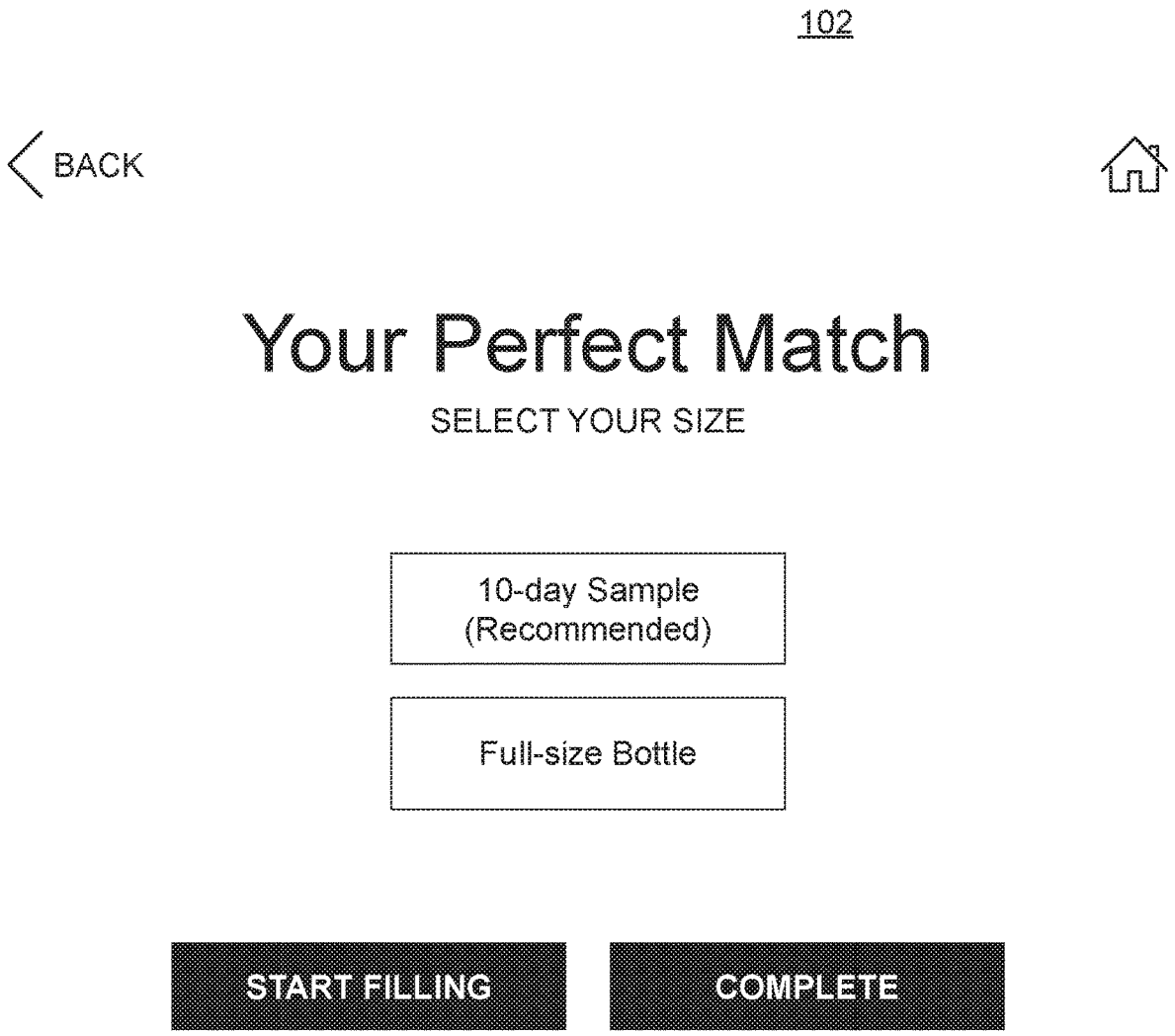
Figure 26A:
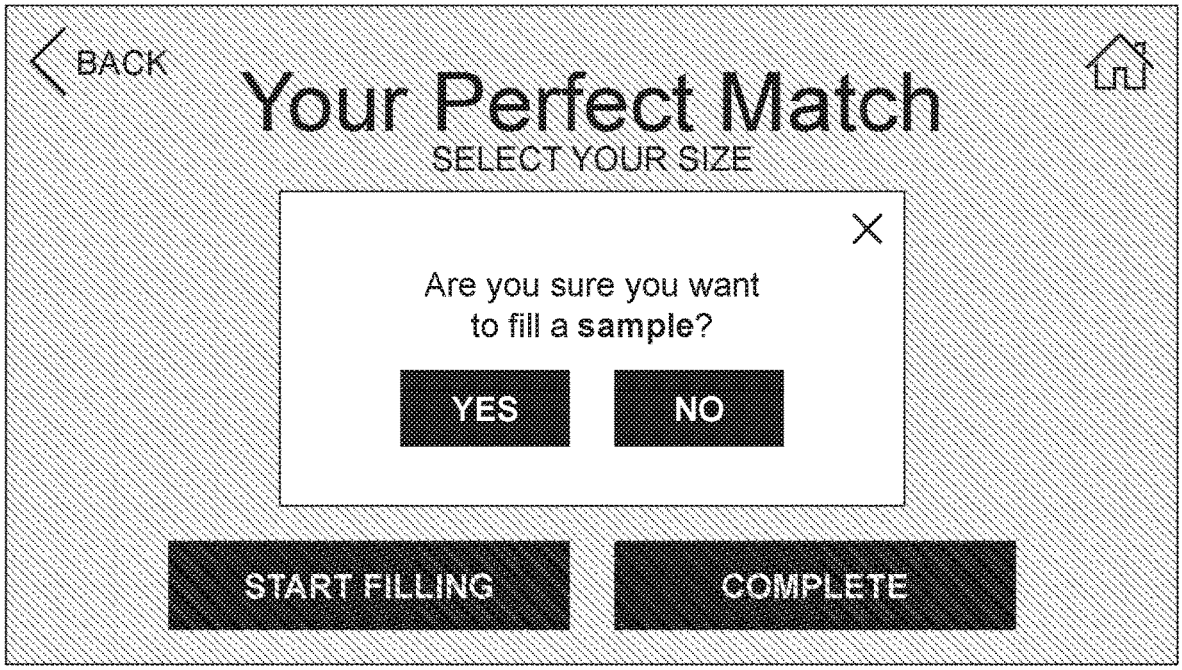
Figure 26B:
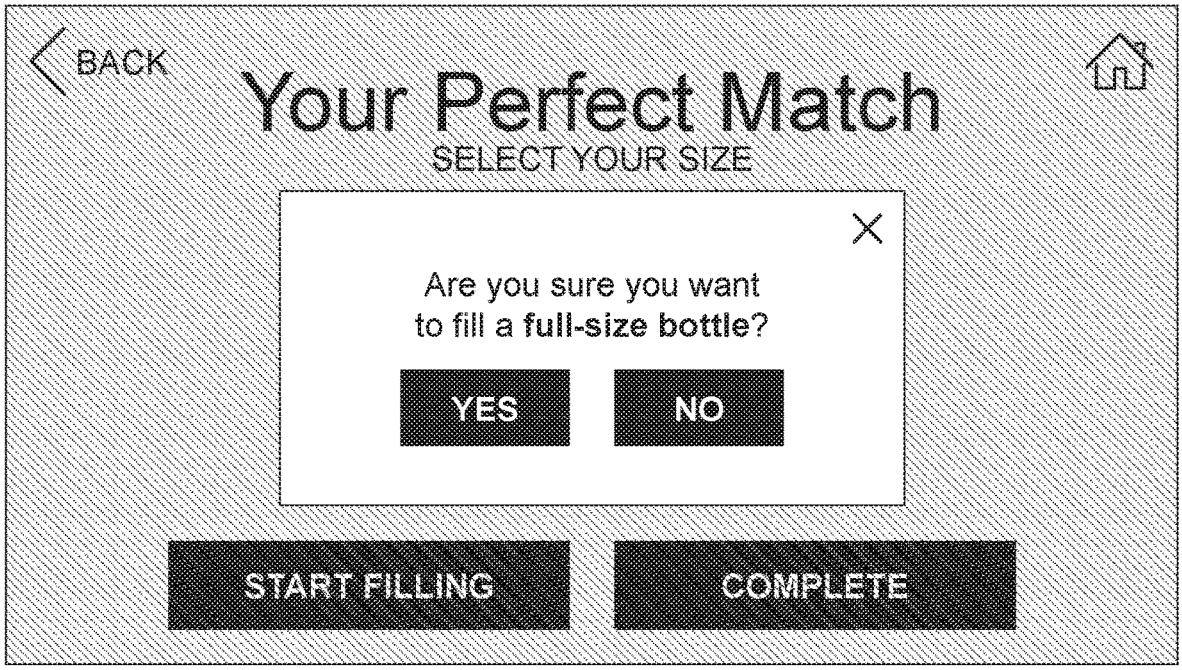
Figure 27:
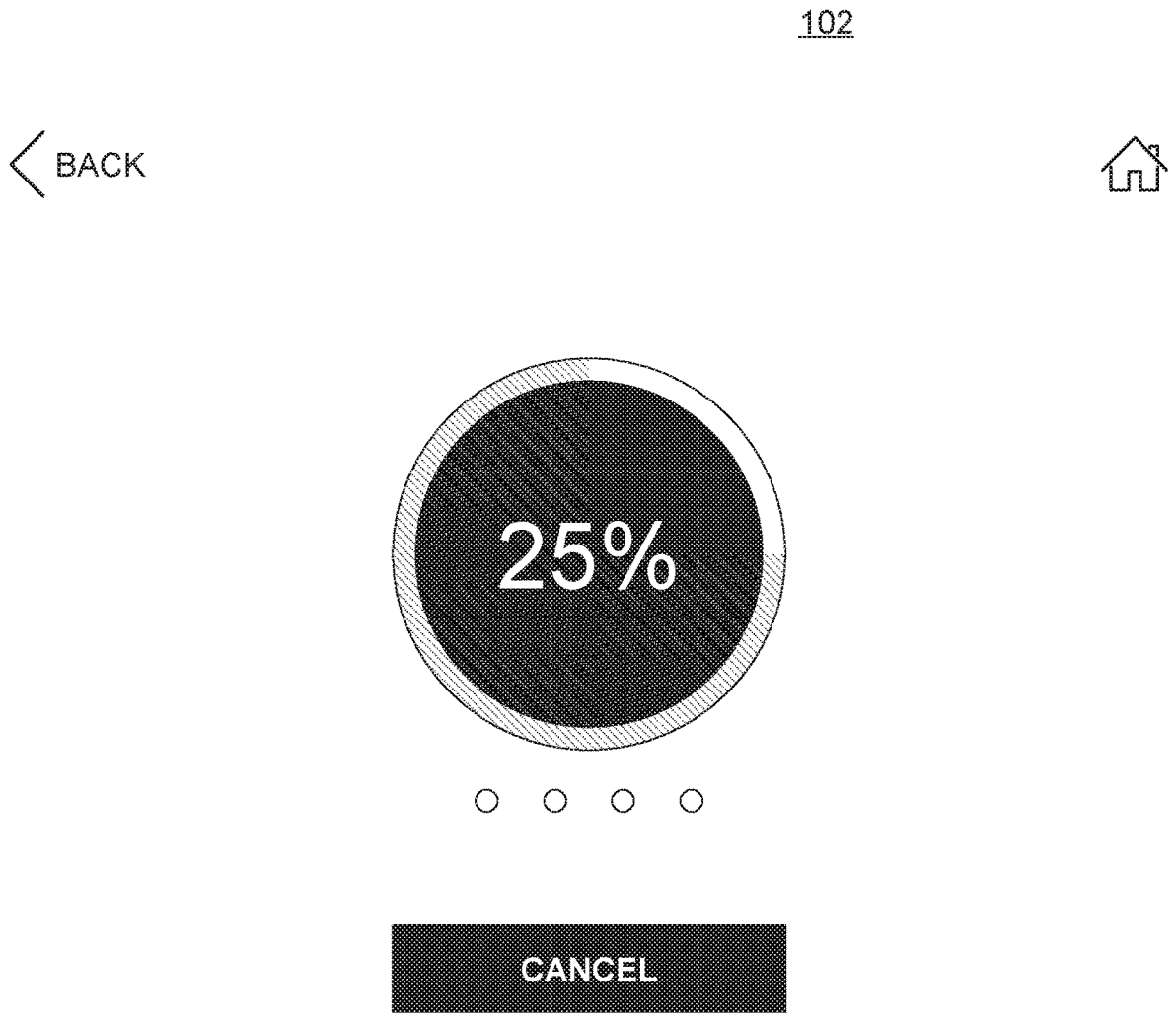
Figure 28:
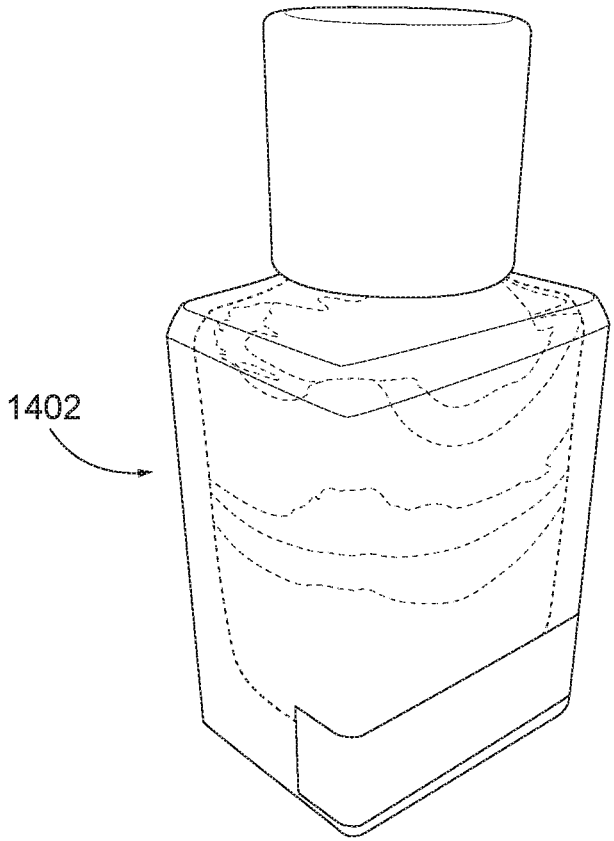
Figure 29:
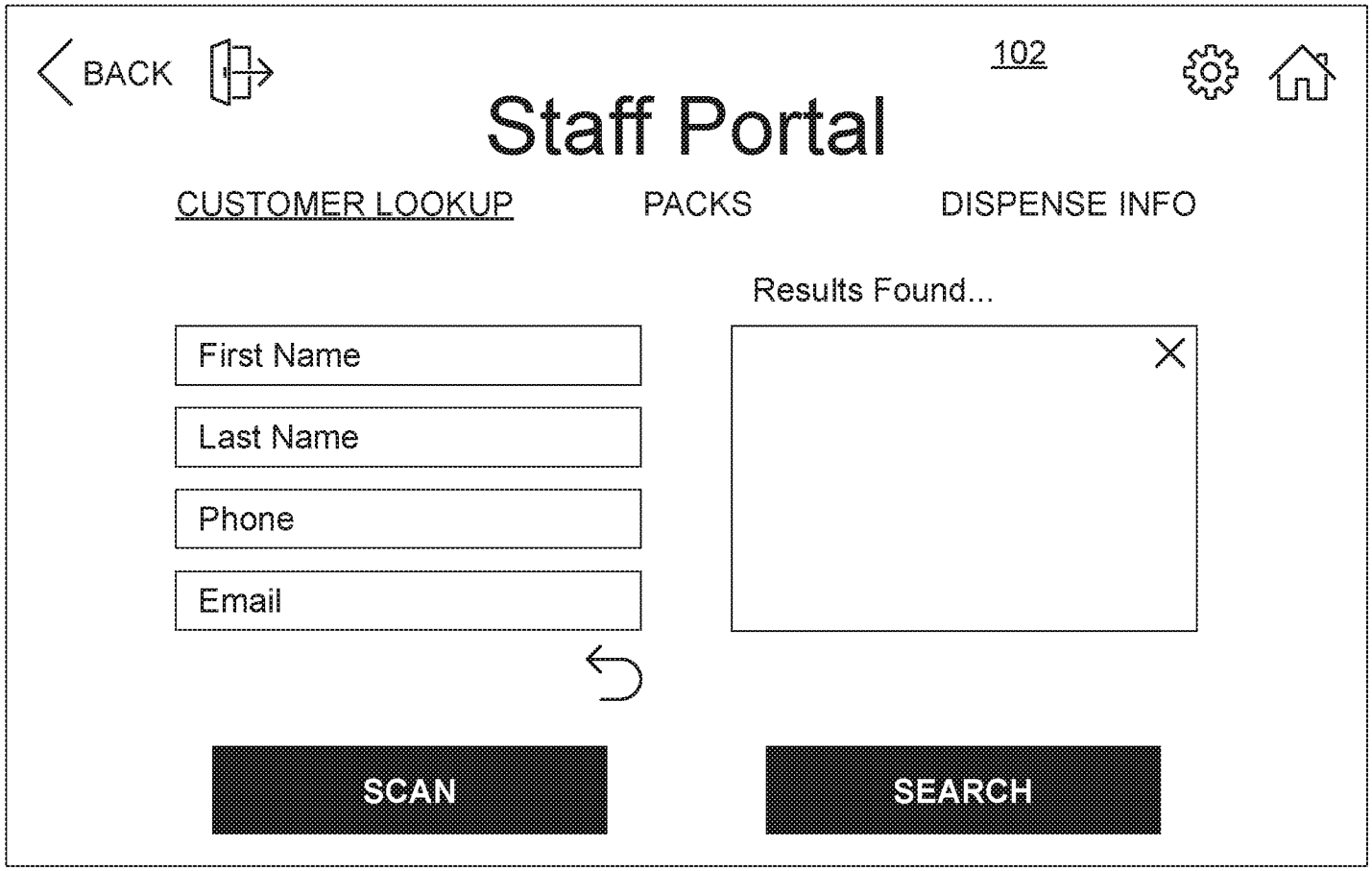

FIG. 18 through FIG. 27 depict exemplary possibilities that may be displayed on the dispenser interface 102, according to embodiments of the present disclosure. For example, a password may be required to access the dispenser unit 100, as shown in FIG. 18. There may also be an option to choose between different types of users, e.g., a consumer or a Beauty Advisor or administrator, as shown in FIG. 19. Dispenser interface 102 may allow obtaining user information, as shown in FIG. 20. Data may be stored in one or more databases, such that the dispenser unit 100 may retrieve data on existing users or create data for a new user/existing user. It should be appreciated that this may be useful when a consumer is a returning consumer who desires to re-purchase a product. The stored data may provide ease of user purchase history lookup or retrieval or previously created customized product specifications. As shown in FIG. 21 and FIG. 22, the dispenser unit may be configured to ask different questions to access user-specific needs (e.g., skin type, desired coverage for a foundation, undertone preference, and other customized features). In an embodiment of the present disclosure, the interface may include an optional instructional video for troubleshooting, completing diagnostic and setup instructions to utilize the dispenser unit 100, and other actions. As shown in FIG. 23, the dispenser interface 102 may also provide instructions to obtain user data using one or more diagnostic tools 1008. It should be appreciated that diagnostic tools 1008 may include a device for measuring color or a spectrocolorimeter. It should further be appreciated that the device or spectrocolorimeter may be stored inside dispenser unit 100. For example, if the dispenser unit 100 is configured for dispensing a customized makeup foundation, a shade matching tool may be utilized to obtain skin tone data of the user by utilizing the device or spectrocolorimeter. A combination of images illuminated with different colors may be captured using the device or spectrocolorimeter. These images may be measured, and an average color or skin tone may be calculated. Using the average color or skin tone, a shade may be matched to this value and stored in a database. The diagnostic or shade matching tool and dispenser interface may analyze and/or measure skin features to diagnose undertones including, but not limited to oil, moisture, skin sensitivity, cleanliness, fatigue, irritation, and other characteristics. The diagnostic or shade matching tool may communicate with the dispenser via Bluetooth, wi-fi or through a wired connection. Dispenser interface 102 may display a series of instructions to capture skin tone-related data. Once the data is obtained, the dispenser interface 102 may display one or more shades that match the user's skin tone profile, as shown in FIG. 24. Dispenser interface 102 may further customize shades by moving toward warmer, cooler, neutral, or combination of shades to enable customization of undertone preference. Then, as shown in FIGS. 25, 26A, 26B, a user may select a product size for the dispenser unit 100 to fill. It should be appreciated that an anti-spill procedure may be implemented to cease dispensing if the bottle is not first detected by the weight measuring system. It should also be appreciated that the dispenser may detect irregularities within the bottle itself. Dispenser interface 102 may provide or display progress of the request, as depicted in FIG. 27. Dispensing assembly 108 may dispense material into a bottle 1402, according to formulations/specifications that may be stored on one or more databases. An exemplary bottle of foundation that may be by the dispenser unit 100 is shown in FIG. 28. Advantageously, the dispenser unit 100 may dispense materials in varying order/sequence to facilitate mixing of contents. For example, the dispenser unit 100 may alternate the materials dispensed instead of dispensing the entire amount of each material at one time (e.g., dispense half the base formula and half the color extenders, repeat this process). The bottle contents may then be mixed by a mixer unit, such as mixer unit 3500, as further delineated below.

The inside of the bottle 1102 or any other container 114 may be coated with a slip or lubricating agent to assist in mixing contents and may prevent the contents from sticking to the sides and/or crevices of the container. A coating process may be performed by spray coating the slip agent or by dispensing a small amount of the slip agent into the bottle when the formulation dispensing process is complete. It should be appreciated that the slip agent may be dispensed before, during or after dispensing the materials. It should also be appreciated that the slip agent may be any constituent of the content/materials in the formulation. For example, the constituent may be a dimethicone, a hydrocarbon, a silicone, and/or combinations thereof.

A different set of options may be displayed on the dispenser interface 102 to another group of users. As shown in FIGS. 29-33, a staff or administrator of the dispenser unit 100 may view status of the dispenser unit 100, such as statistics of the material packs 601*a* . . . 601*n*, so as to refill when needed or desired, according to embodiments of the present disclosure. RFID tags may be utilized to track each dispensing action and may notify the user when a specified or certain amount of each product remains. This may prevent the dispenser from beginning the process of creating a shade when enough product is not available. Incoming raw material lots may be pre-evaluated for color trueness and/or color intensity. It should be appreciated that this information may be programmed into the RFID for the corresponding lot of material. Upon reading the RFID, the dispensing algorithm may automatically adjust the recipe, based on the intensity and/or color trueness of the raw material. As another example, the settings of the dispenser unit 100 (e.g., motor speed of each motor) may be individually adjusted and monitored via the dispenser interface 102 to ensure proper operation. Moreover, a sanitization procedure may be performed via controls displayed on the dispenser interface 102. Sanitation may be performed by chemicals, light, heat, air blades, etc.

Figure 30:
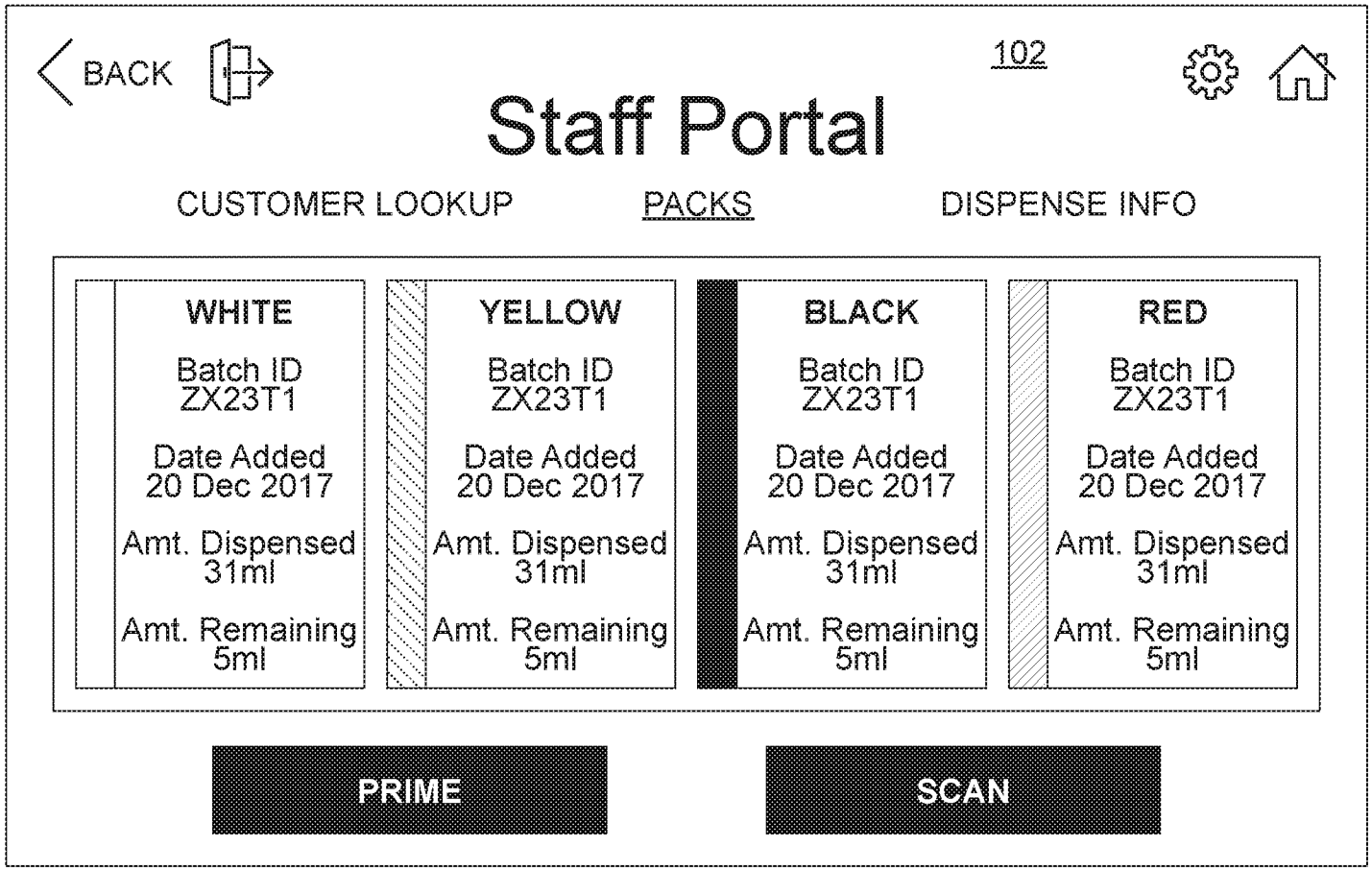
Figure 31:
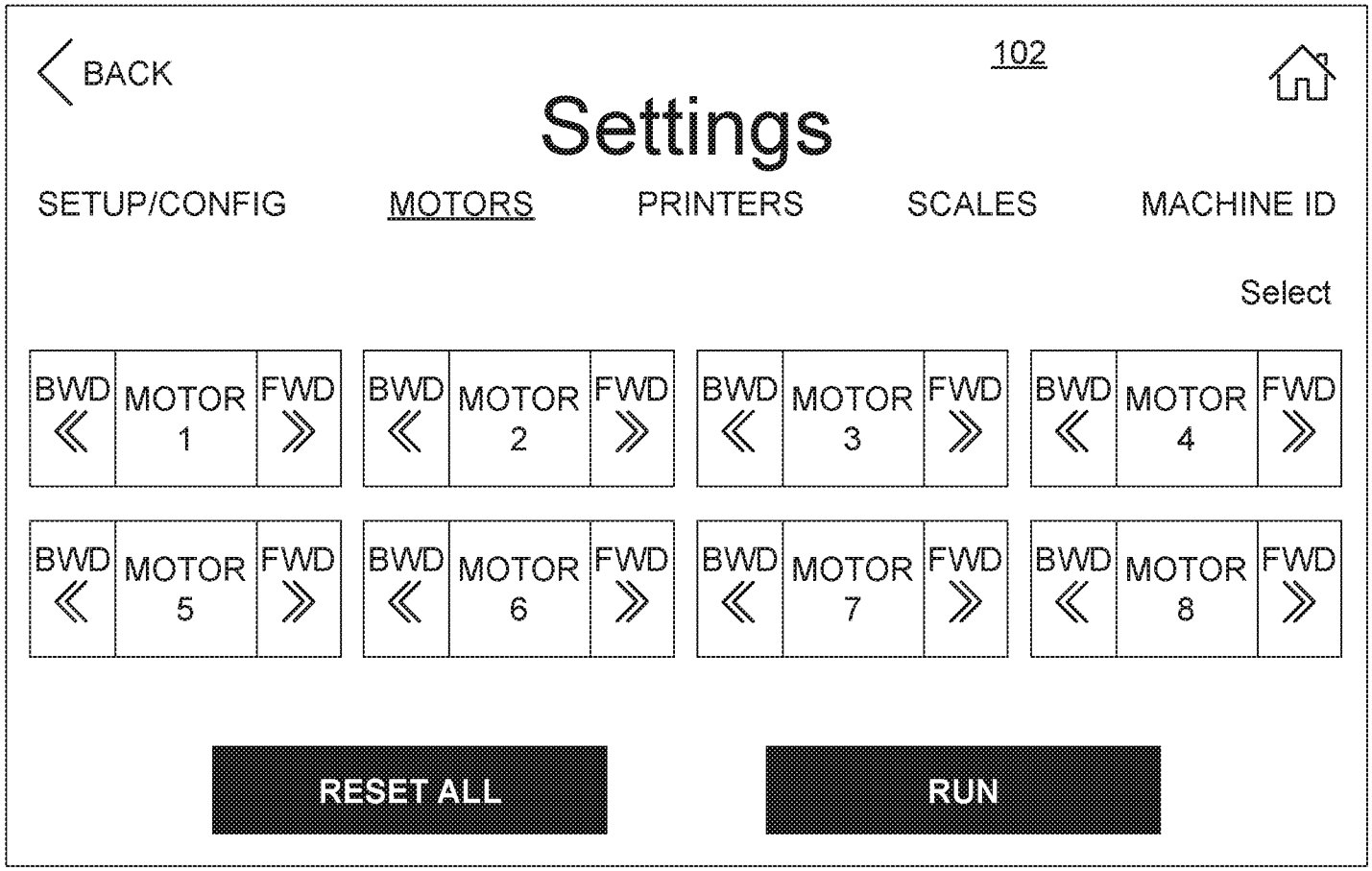
Figure 32:
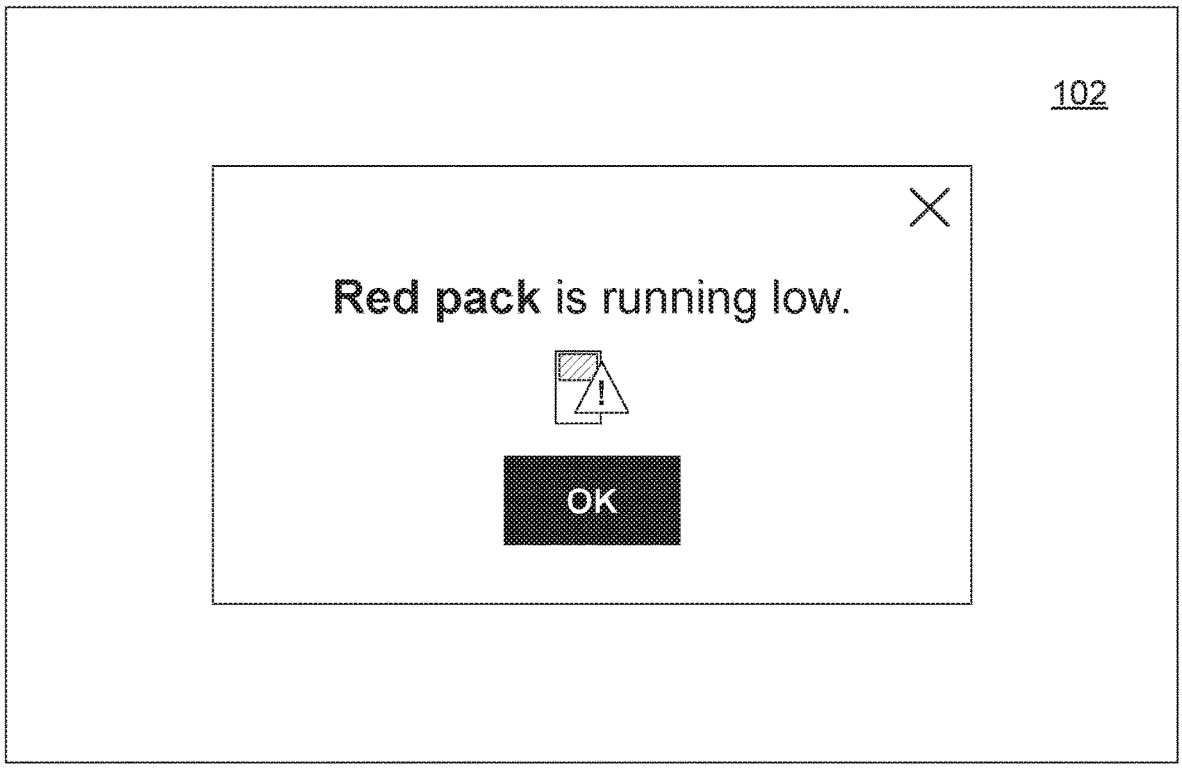
Figure 33:
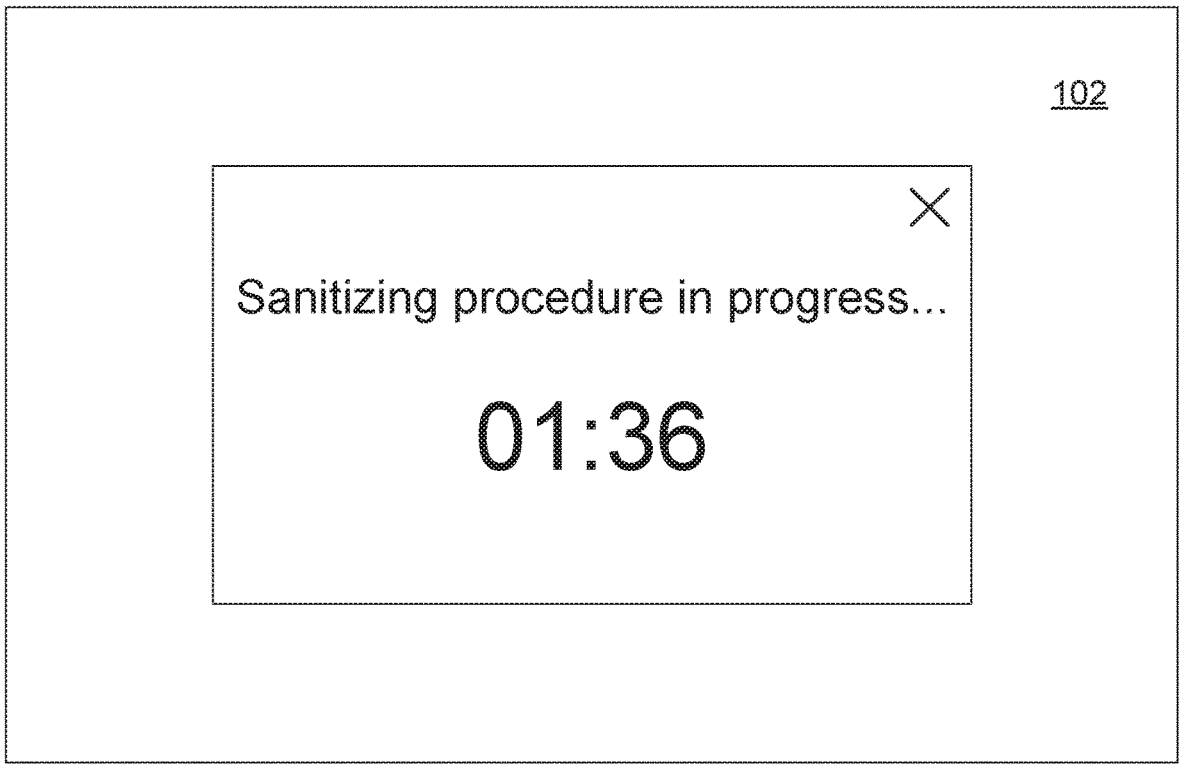
Figure 34:
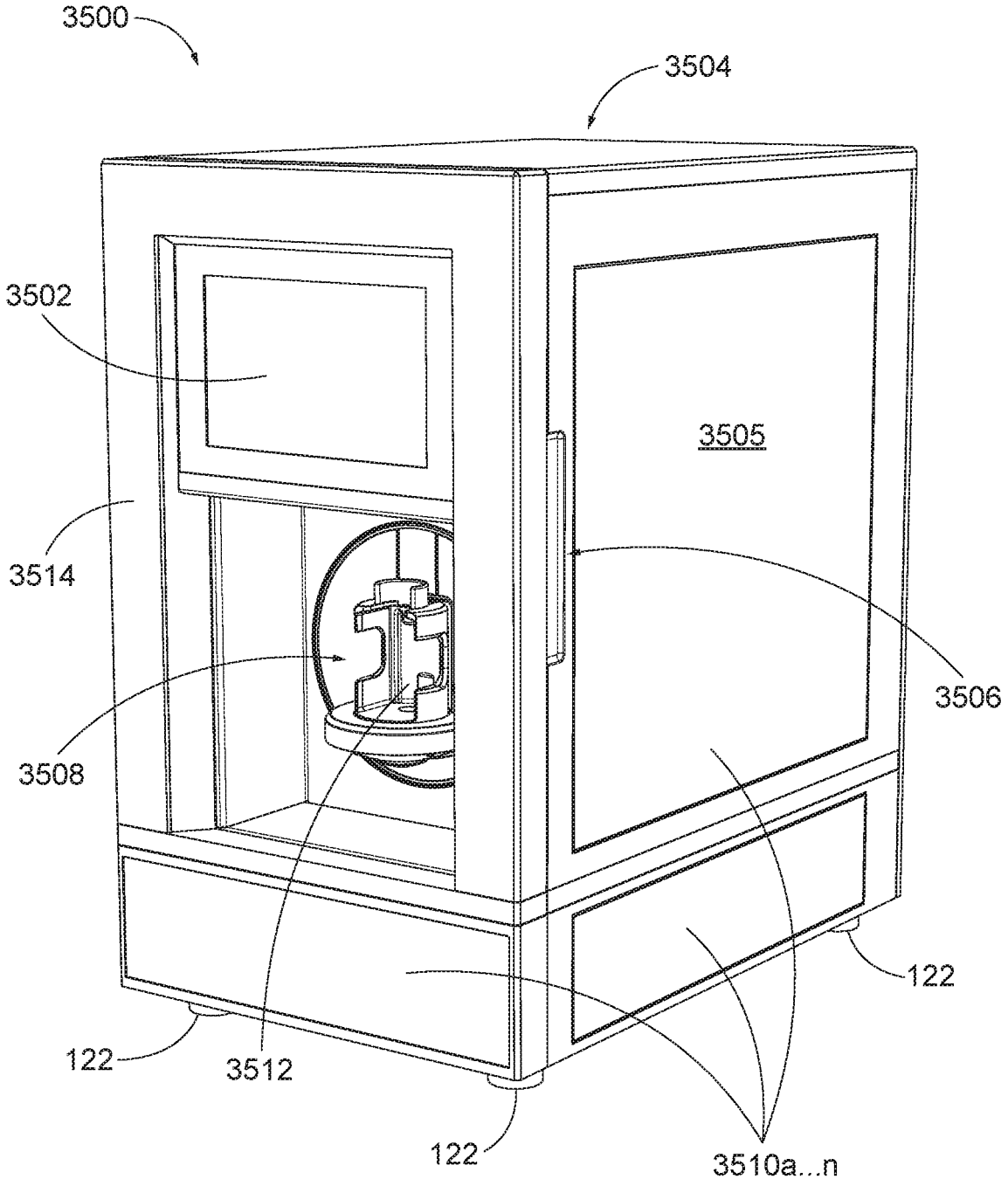
FIG. 34 depicts a perspective view of a mixing unit for mixing one or more cosmetic ingredients and/or compositions according to embodiments herein.

In some embodiments, the dispenser interface 102 may be a permanent element of the dispenser unit 100. For example, FIG. 30 depicts a portal that may provide a user with an ability to select and customize constituents or materials to be mixed and dispensed as a customized composition. It should be appreciated that preselected and saved constituents may be selected from dispenser interface 102. In other embodiments, the dispenser interface 102 may be a removable feature, such as a tablet or another portable device capable of providing user interaction.

Referring to FIG. 3534, a mixer unit 3500 may include a mixer interface 3502 for interaction between a user and the mixer unit 3500, according to an embodiment of the present disclosure. Mixer unit 3500 may include a mixing assembly 3508 that may provide a container cradle 3512. Mixer unit 3500 may further include a storage container 3504, a side door 3505 with door handle 3506, one or more POS displays 3510*a* . . . 3510*n*, and a front door panel 3514. Mixer unit 3500 and dispenser unit(s) may be temperature controlled, heated, and/or maintain a specific temperature that may improve the mixing of highly viscous product. It should be appreciated that mixer unit 3500 and dispenser units may be applicable to products having higher and/or lower viscosities to control temperature.

Figure 35:
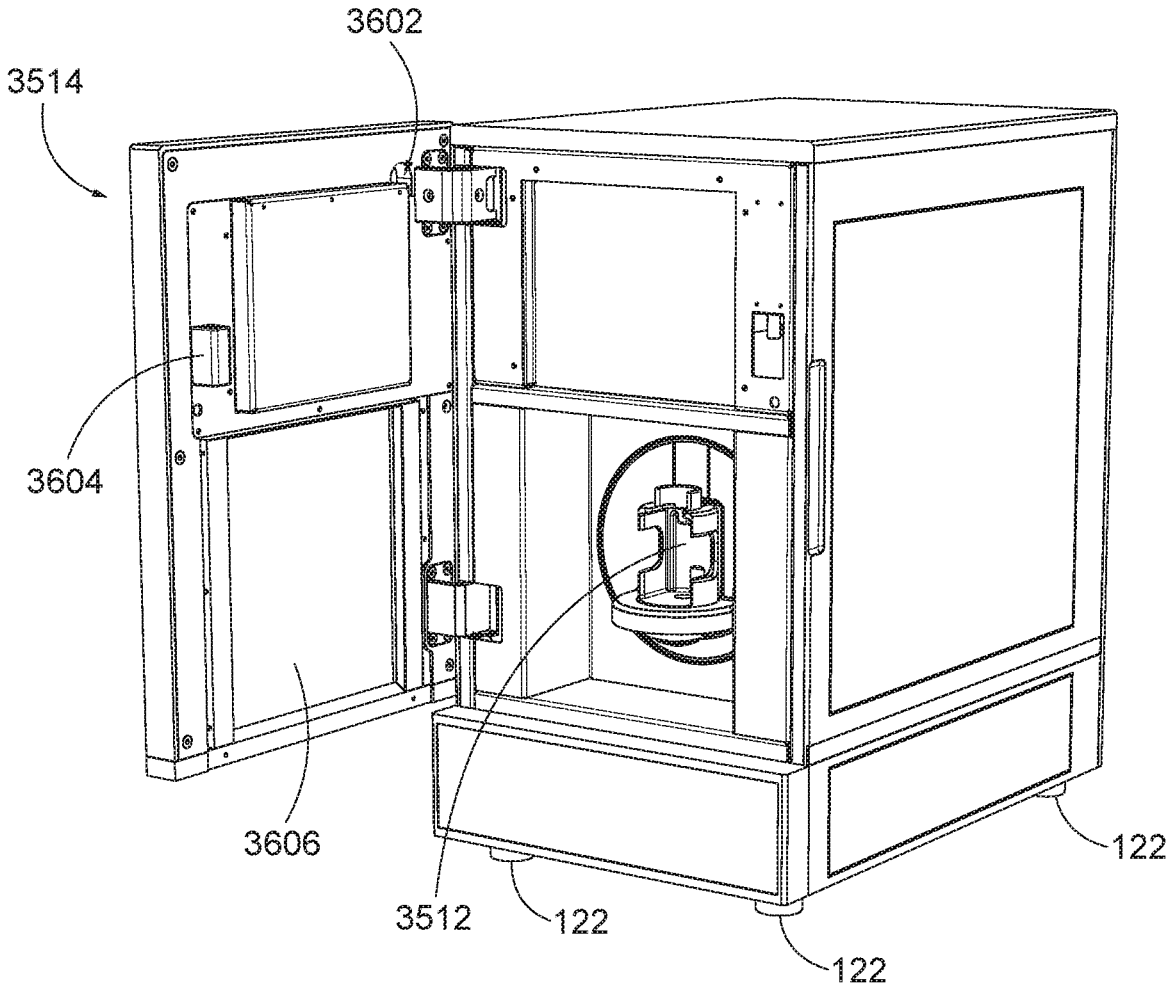
FIG. 35 depicts a front perspective view of the mixing unit of FIG. 34 with the front door panel in an open configuration, according to an embodiment of the present disclosure.

FIG. 35 depicts a perspective view of the mixer unit 3500 with the front door panel 3614 in an open position, according to an embodiment of the present disclosure. Front door panel 3614 may include a screen power switch 3602 which powers the mixer interface 3502 on or off. Front door panel 3514 may also include a door lock mount 3604 for locking the front door panel 3514 in place, and a protective screen 3606 may be positioned in front of the mixing assembly 3508. Front door panel 116, where possible, may be created to provide enough clearance to allow the door to open without striking the bottle when the bottle is placed in front of the door. It should be appreciated that sound absorbing insulation may be provided within the unit.

Figure 36:
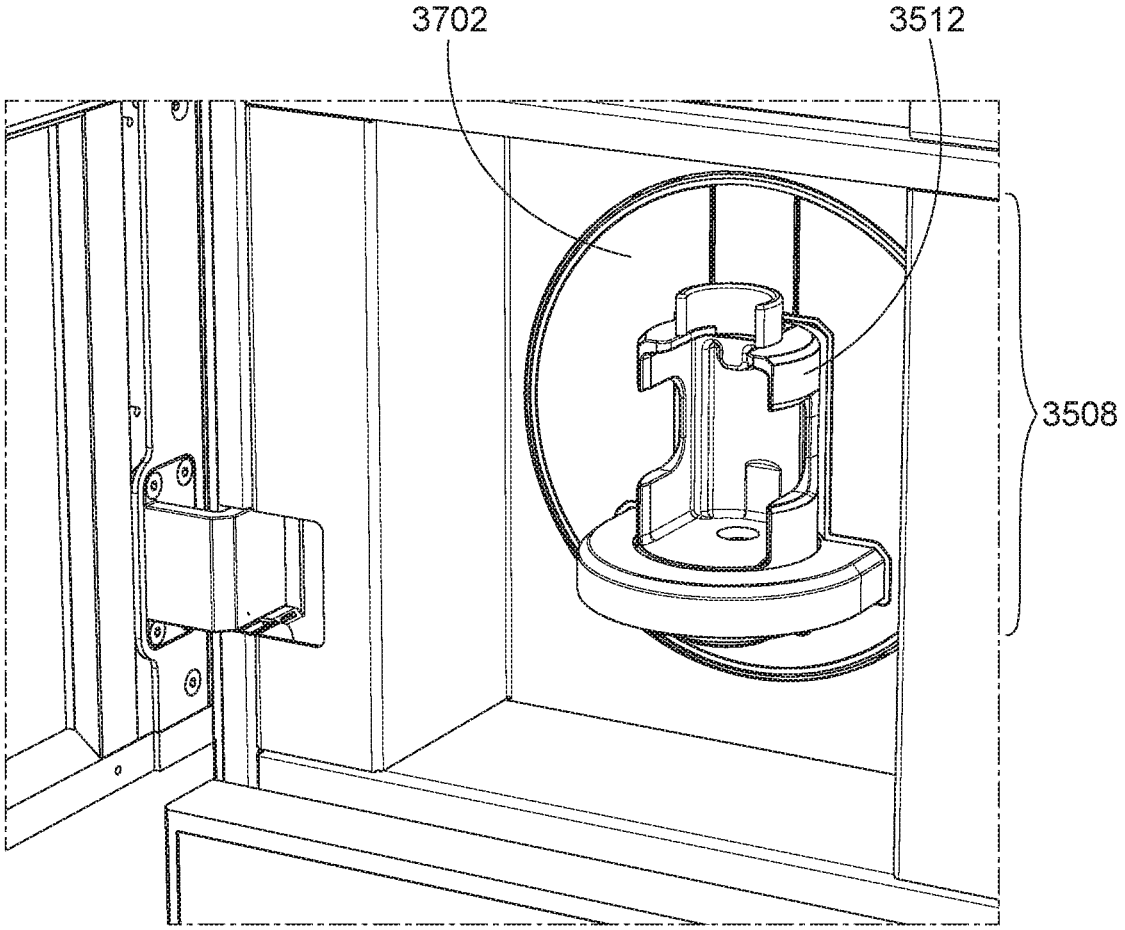
FIG. 36 depicts a partial view of the mixing platform and a bottle cradle of the mixing unit of FIG. 34, according to an embodiment of the present disclosure.
Figure 37A:
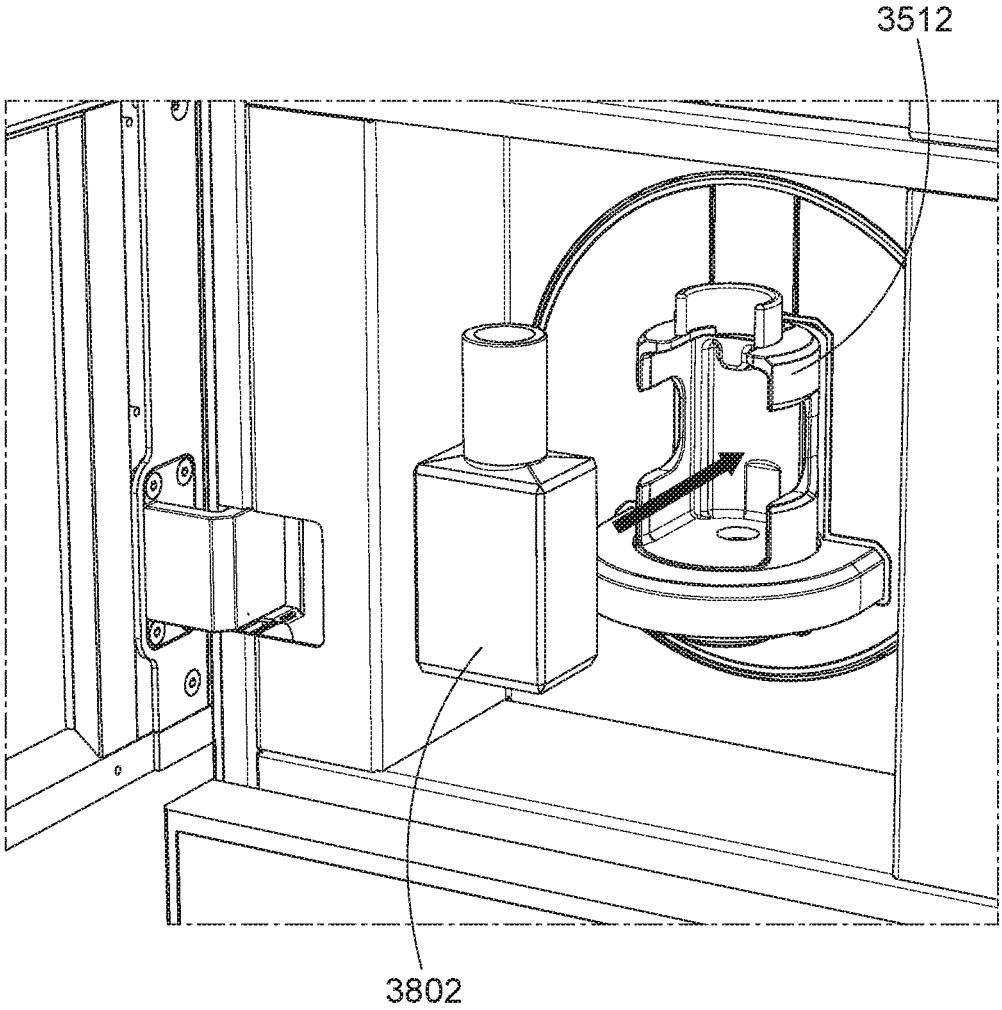
FIG. 37A depicts a partial view of a bottle being placed in the bottle cradle of FIG. 36, according to an embodiment of the present disclosure.
Figure 37B:
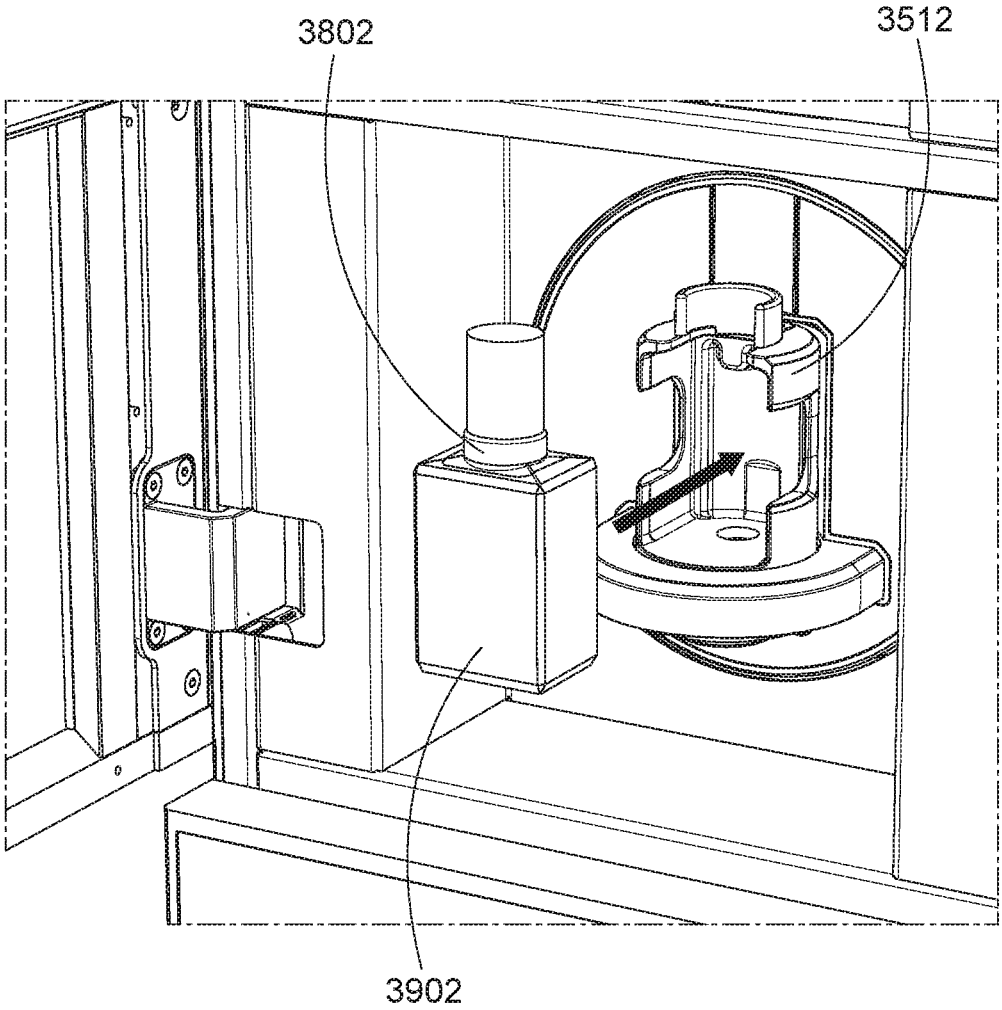
FIG. 37B depicts a partial view of a bottle in a bottle sleeve being placed in the bottle cradle of FIG. 36, according to an embodiment of the present disclosure.

FIG. 36 depicts an enlarged view of the mixing assembly 3508, according to an embodiment of the present disclosure. Mixing assembly 3508 includes a rotational plate 3702 and container cradle 3512. The rotational plate may be counter balanced for eccentrically weighted packages. As shown in FIG. 37A, the container cradle 3512 may be configured to receive and hold a container, such as bottle 3802. As shown in FIG. 37B, the bottle 3802 may be inserted into a bottle sleeve 3902.

Figure 37C:
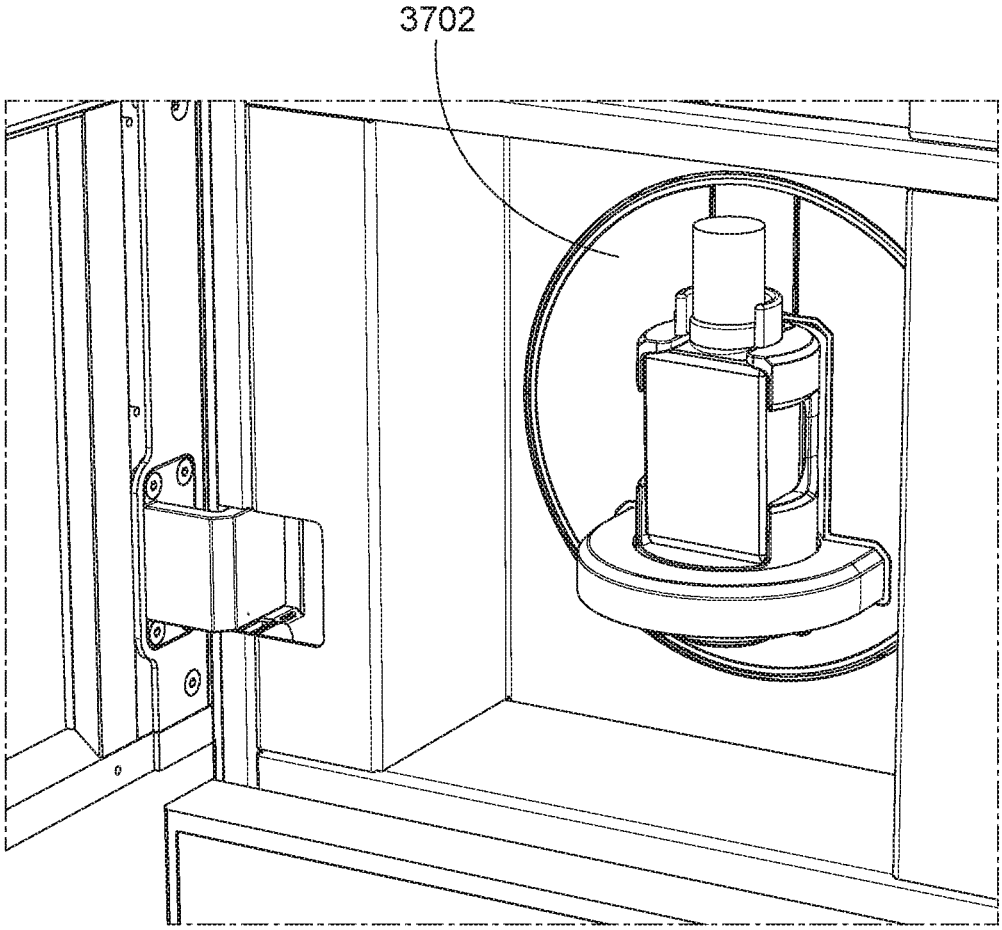
FIG. 37C depicts a partial view of the bottle in the bottle sleeve in proper configuration in the bottle cradle of FIG. 37B, according to an embodiment of the present disclosure.
Figure 54:
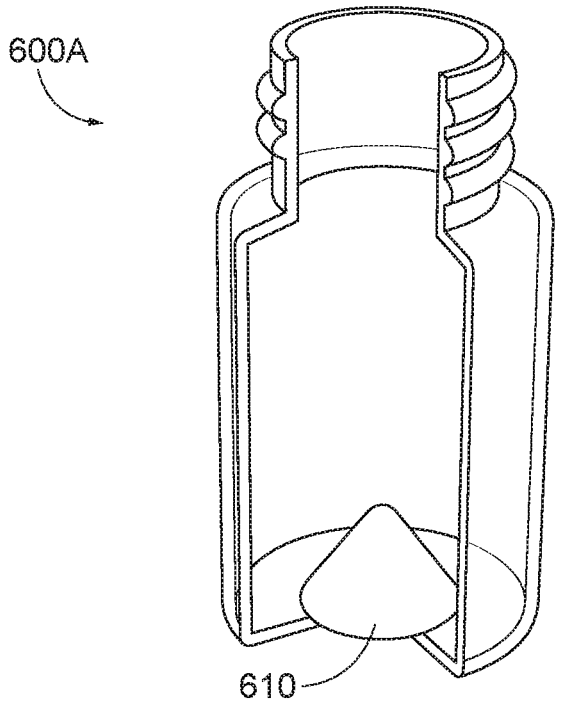
FIG. 54 depicts an exemplary plug for a bottle, according to an embodiment of the present disclosure.
Figure 55:
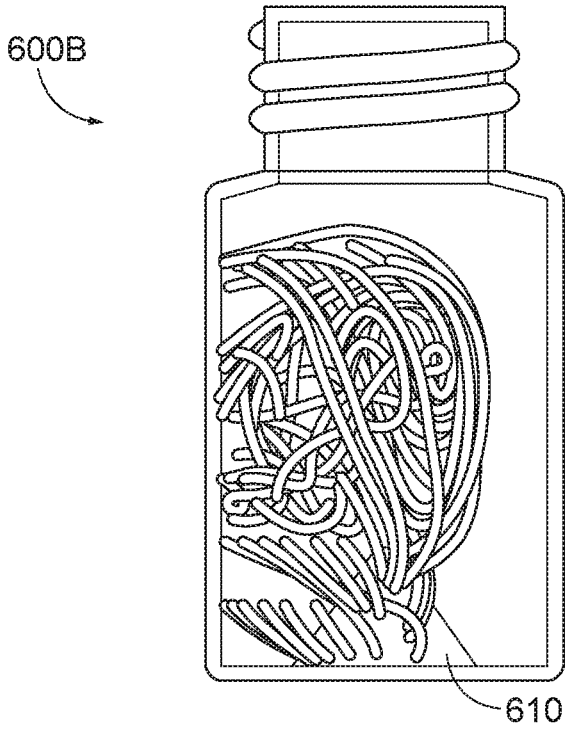
FIG. 55 depicts an exemplary plug for a bottle, according to an embodiment of the present disclosure.

It should be appreciated that a standard format may be provided these units. Bottle sleeve 1504 may allow multiple sized packaging to be utilized. The bottle sleeve may adjust to correspond to the exterior size of the parent shape or standard format. There may also be a spring mechanism to help retain the bottle in the container cradle 3512. The bottle sleeve is also used to position the bottle center of mass about the center of the axis of rotation. Once the bottle is secured as shown in FIG. 37C, the rotational plate 3702 is configured to rotate according to a preset program. In certain embodiments, bottle or bottle neck 600A, 600B may be fit with plug 610 (FIGS. 54 and 55) to prevent contents 620 from adhering to the side of the bottle neck during mixing. It should be appreciated that plug 610 may have a concave or a convex shape or structure. It should also be appreciated that plug 610 may have a frustoconical shape. Also, having the plug at certain depths around the base of the "H" dimension allows for better motion of the ingredients being mixed. This can also allow the neck of the bottle to be eliminated from the mix completely. The plug can also be used to prevent the bottle cap from unscrewing itself and ensure the cap is fully seated in the bottle fitment area, especially while moving at high speeds.

Figure 38A:
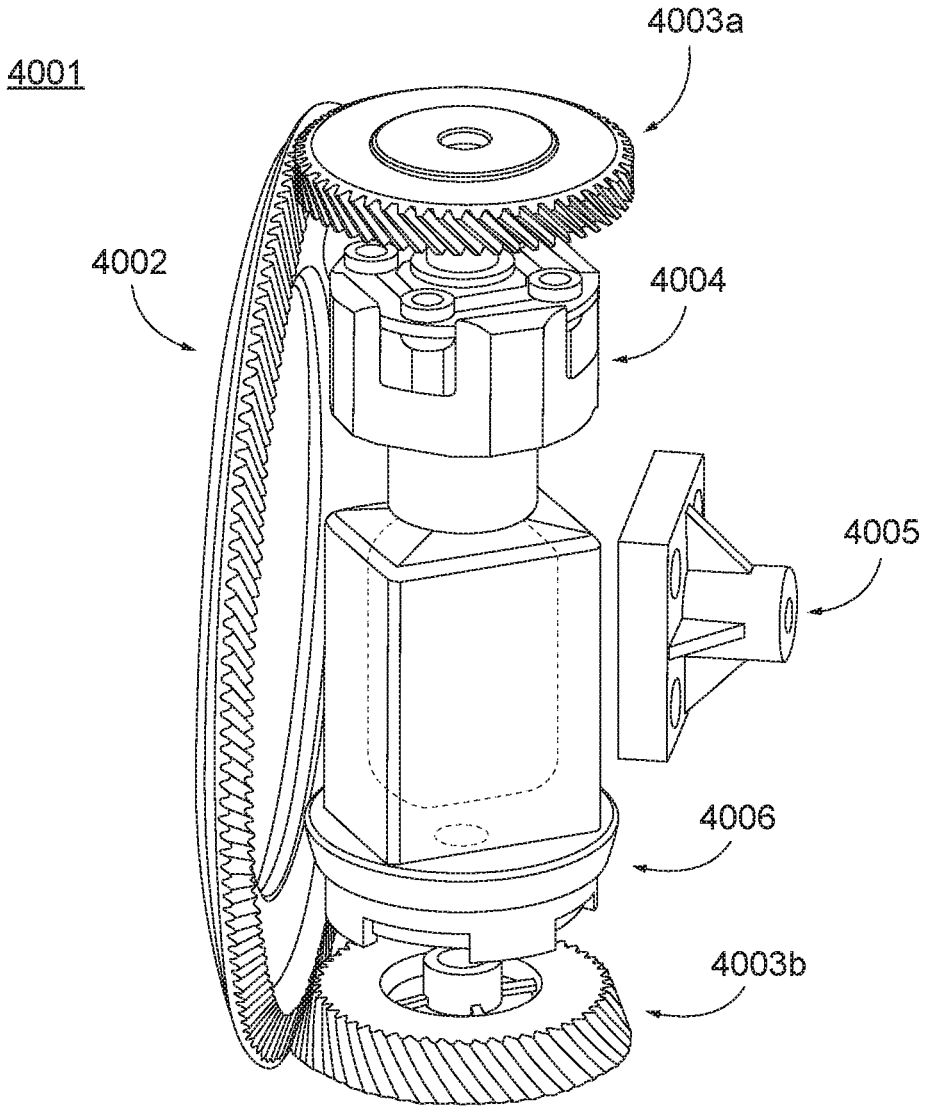
FIG. 38A depicts a perspective view of an exemplary rotational assembly in the mixing platform of FIG. 36, according to an embodiment of the present disclosure.
Figure 38B:
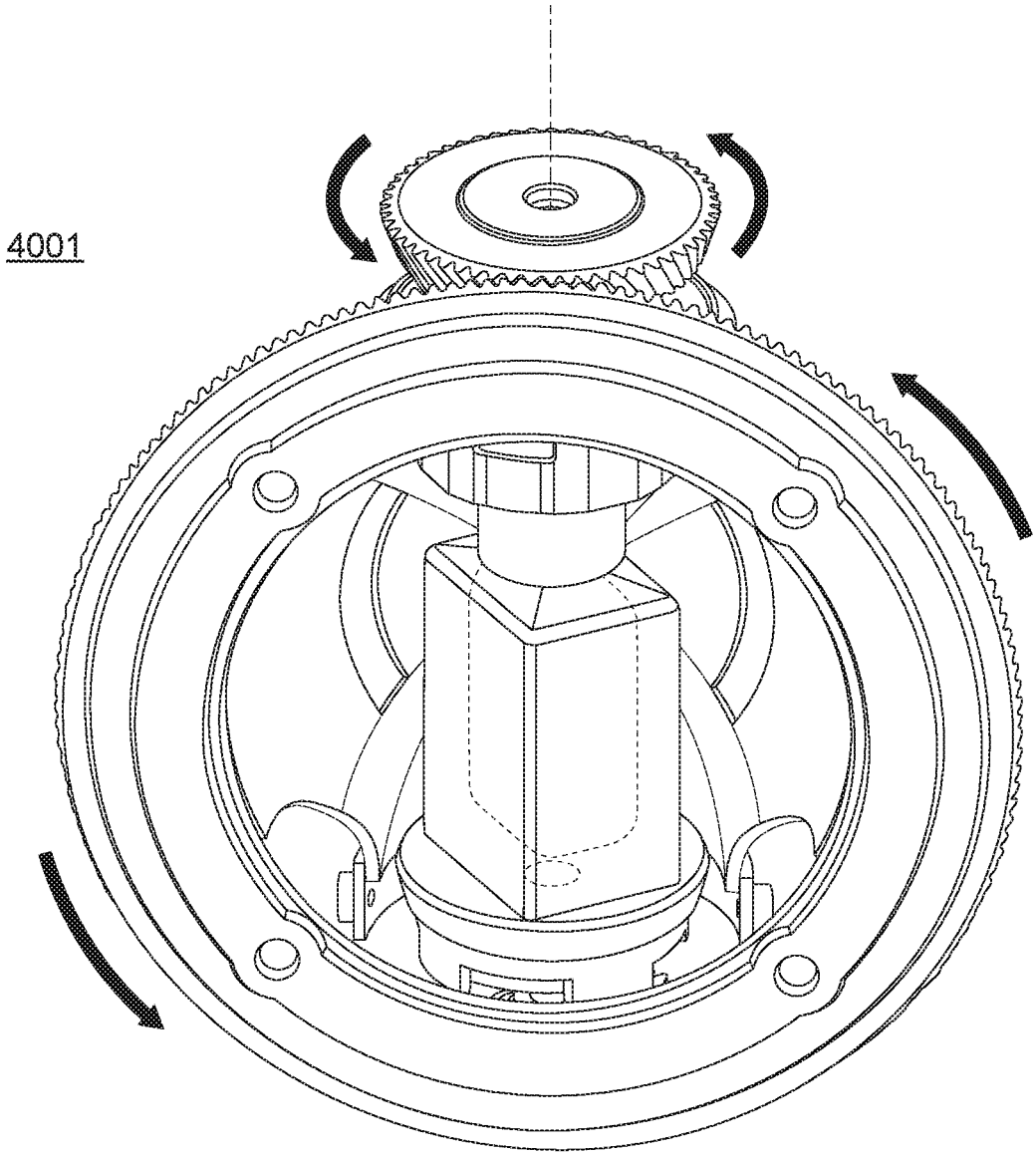
FIG. 38B depicts a side view of the rotational assembly of FIG. 38A, according to an embodiment of the present disclosure.
Figure 38C:
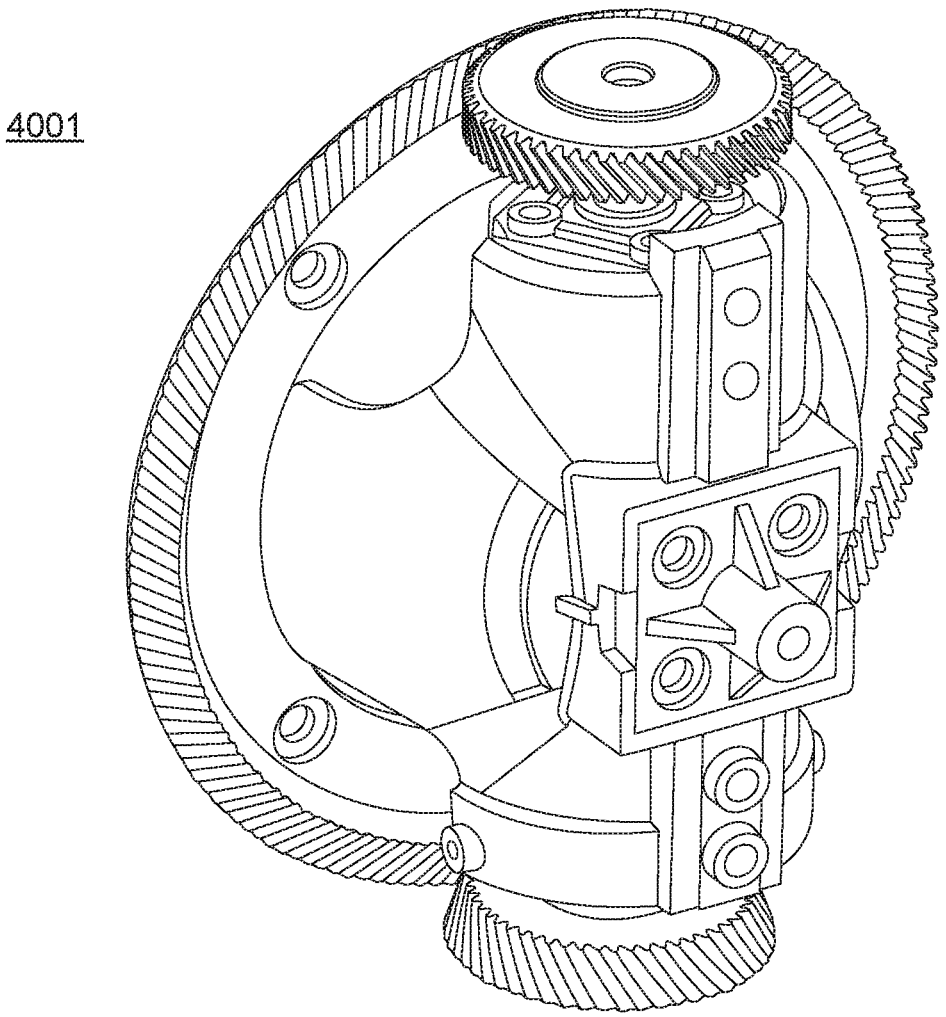
FIG. 38C depicts a rear view of the rotational assembly of FIGS. 38A and 38B, according to an embodiment of the present disclosure.

FIGS. 38A-38C show the rotational gears behind the rotational plate 3702 that enable rotation in different directions and axis, according to an embodiment of the present disclosure. Rotational assembly 4001 includes a stationary element 4002, an axial rotating element 4003*a*, an axial rotating element 4003*b*, a distal fitment 4004, a drive coupling 4005, and a primary fitment 4006. In embodiments, at least one of the primary fitment 4006 and distal fitment 4004 is a driving fitment. In some embodiments, at least one of the primary fitment 4006 and distal fitment 4004 is a gear. At least one of the fitments can be spring-loaded to allow for height adjustments to accommodate components of different shapes and sizes as well as retain the bottle. Distal fitment 4004 may contact the top, the shoulder, or side of the component, while the primary fitment 4006 is in contact with the bottom of the component. Stationary element 4002 can be a stationary gear if it has teeth, or a stationary surface if it has a smooth surface. Drive coupling 4005 is connected to a drive system, such as a stepper motor, to drive rotation of the component. Distal fitment 4004 is also used to prevent the bottle cap from unscrewing during high speeds.

Rotational assembly 4001 includes gyroscopic mixing and off-centered rotation. Elements 4002, 4003*a*, and 4003*b* can be designed to have teeth or as a smooth/flat surface. This mechanism allows for achieving a spin on two different axes. The axis of rotation and mechanism also makes the bottle accessible to operate/insert/remove in a horizontal, vertical or diagonal position. Moreover, by having the center of mass at an offset from the center of rotation, for example, a few millimeters offset to the center of rotation, mixing through agitation is also achieved. The off-center spin causes the center of inertia of the bulk/ingredients to shift, thereby causing vertical (up and down) motion, effectively vibrating, especially at high speeds. This method of gyroscopic mixing allows for effectively mixing products in any component, e.g., various sizes and shapes such as square or cylindrical shapes. This gyroscopic mixing may allow the ingredients to tumble within a package on two different axes (i.e., larger and smaller).

As shown in FIGS. 38A-38C, the smaller wheels or axial rotating elements 4003*a* and 4003*b* are rotating about the larger wheel (e.g., stationary element 4002) by means of geared teeth, according to an embodiment of the present disclosure. The elements can be metal, plastic, or rubber. Advantageously, rubber wheels can greatly reduce the sound of the mixing mechanism while in process by dampening the decibel level of the mixing apparatus.

In an embodiment, the smaller axis is designed at a ratio at least 3 times smaller than that of the large axis, for example, at a ratio of 4:1 (larger axis:smaller axis). At this ratio, for every single or one (1) rotation of the stationary element 4002, the axial rotating elements 4003*a* and 4003*b* will rotate four (4) times. This allows the product to spin four times faster in the smaller axis than the actual RPM of the driving mechanism of the larger axis, which improves mixing efficacy. In other embodiments, the size of the axial rotating wheel and the stationary wheel may be the same or the axial rotating wheel may be larger than the stationary wheel.

The mixer unit 3500 may also include strobe lights mounted onto the door (or other parts) of the mixer unit. The strobe lights allow for visual capturing of the bottle in its upright position (or any other position) throughout. This allows the consumer/user to visually view the blend from its original extender layers into the final fully blended shade. For example, the mixer unit 3500 may be equipped with a camera to capture and stream the mixing process on the mixer interface 3502.

Figure 39:
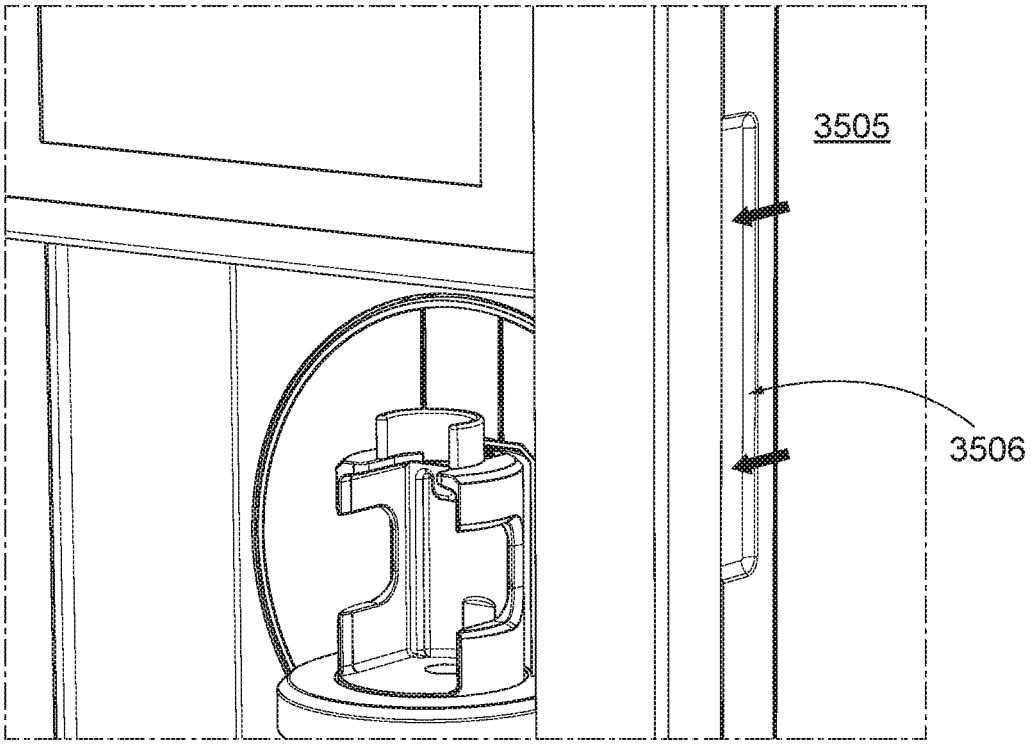
FIG. 39 depicts a partial view of a side door panel of the mixing unit of FIG. 34, according to an embodiment of the present disclosure.

FIG. 39 depicts an enlarged view of the side door 3505 and door handle 3506, according to an embodiment of the present disclosure. A magnetic interlock or other coupling mechanisms may be used to secure the side door 3505 and avoid particles or projectiles from exiting the mixer. As a safety feature, if the side door 3505 is opened while the mixer unit 3500 is operating (e.g., spinning), the machine automatically stops within one second.

Figure 40:
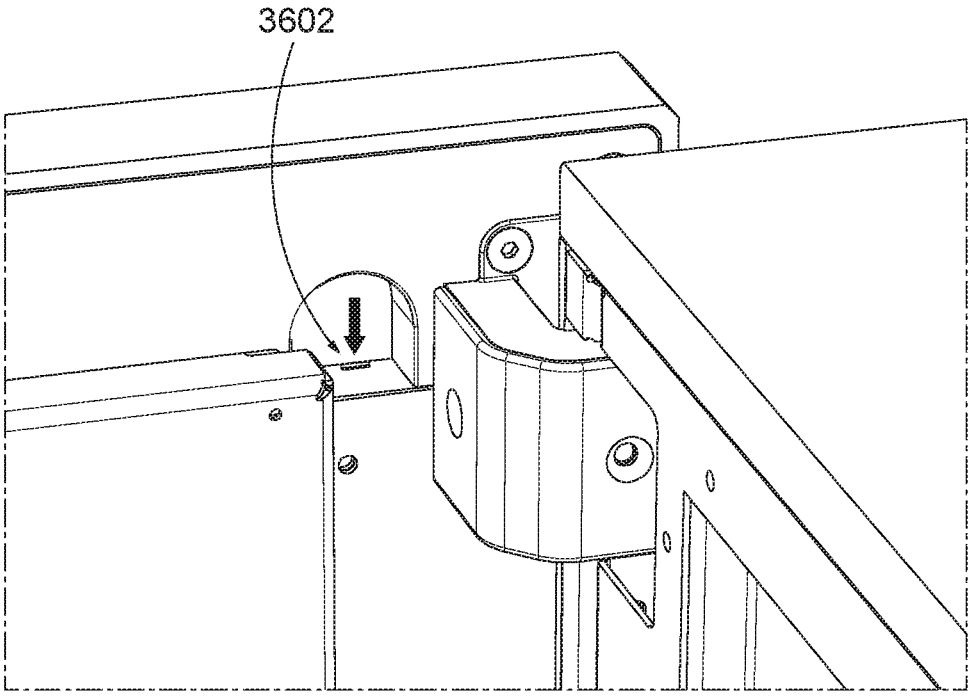
FIG. 40 depicts a partial view of the front door panel of the mixing unit of FIG. 34 having a screen power button configured thereon, according to an embodiment of the present disclosure.

FIG. 40 depicts an enlarged view of the screen power switch 3602, which may be used to control power to the mixer interface 3502.

Figure 41:
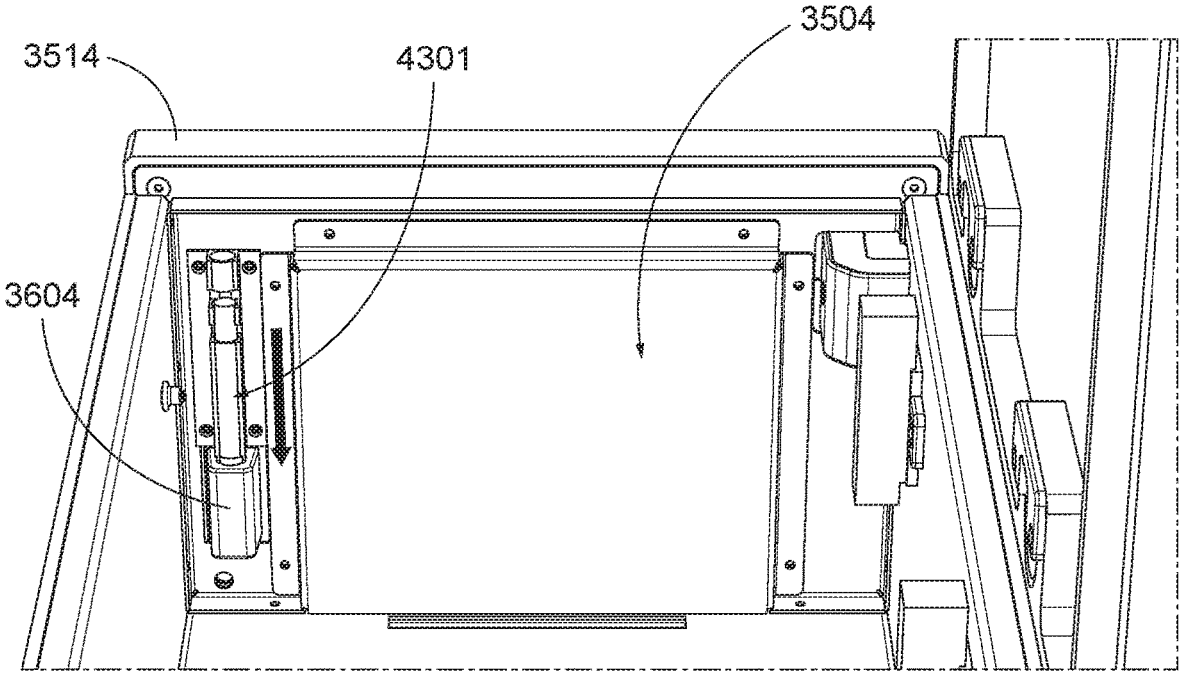
FIG. 41 depicts a partial view of a top storage container and locking mechanisms in the storage container of the mixing unit of FIG. 34 in an open position, according to an embodiment of the present disclosure.

FIG. 41 depicts an enlarged view of the storage container 3504, which includes a locking mechanism 4301 configured to engage the door lock mount 3604 of the front door panel 3514, according to an embodiment of the present disclosure. While a bolt-lock mechanism is shown, other locking mechanisms may be utilized.

Figure 42:
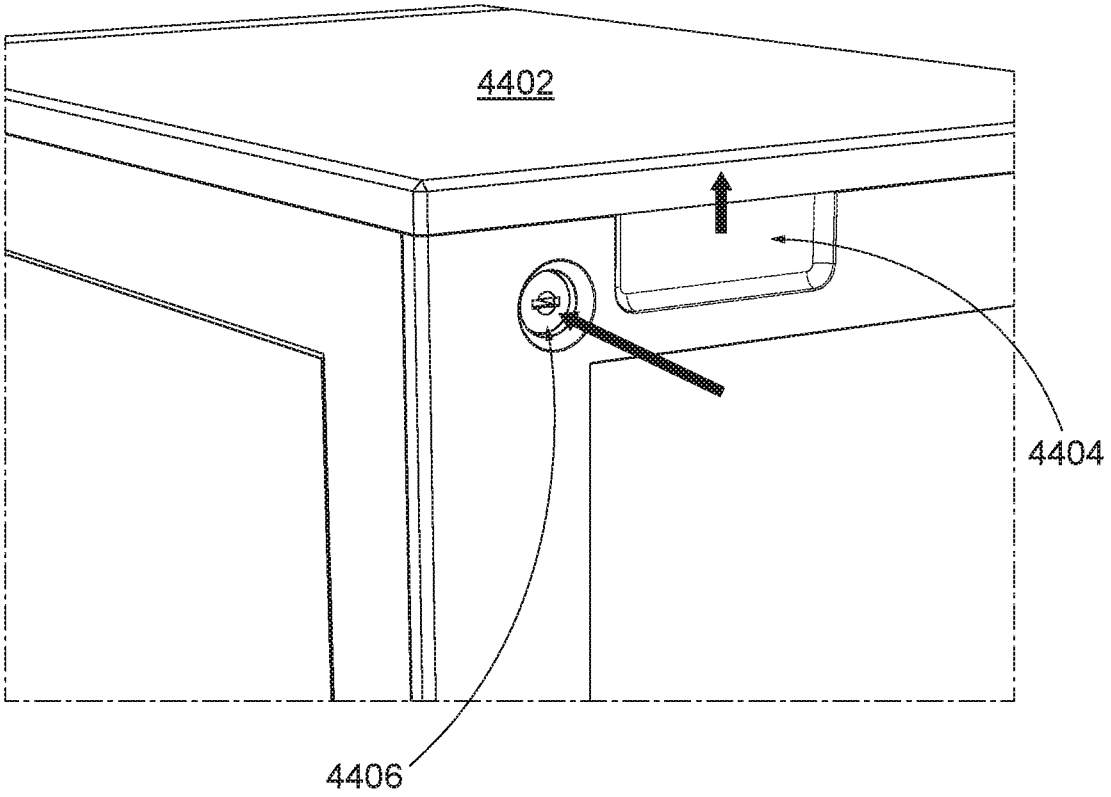
FIG. 42 depicts a partial view of a locking mechanism for the storage container of FIG. 41, according to an embodiment of the present disclosure.

FIG. 42 depicts an enlarged view of the locking mechanism for the storage container 3504, according to an embodiment of the present disclosure. Storage container 3504 may include a storage container door 4402, a storage container door handle 4404, and a lock 4406 to lock the storage container 3504.

Figure 43:
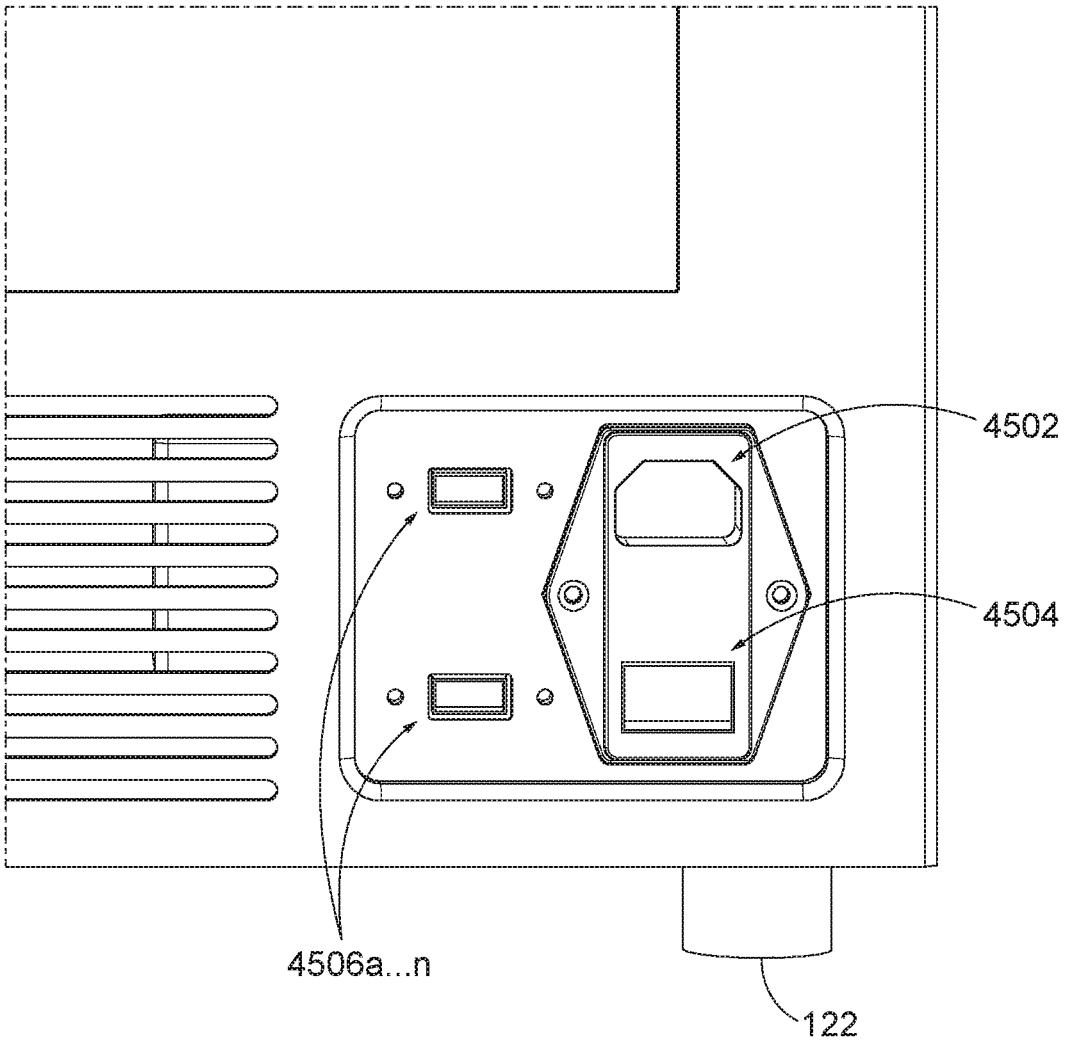
FIG. 43 depicts a partial view of a panel for external inputs and/or outputs for the mixing unit of FIG. 34, according to an embodiment of the present disclosure.
Figure 44:
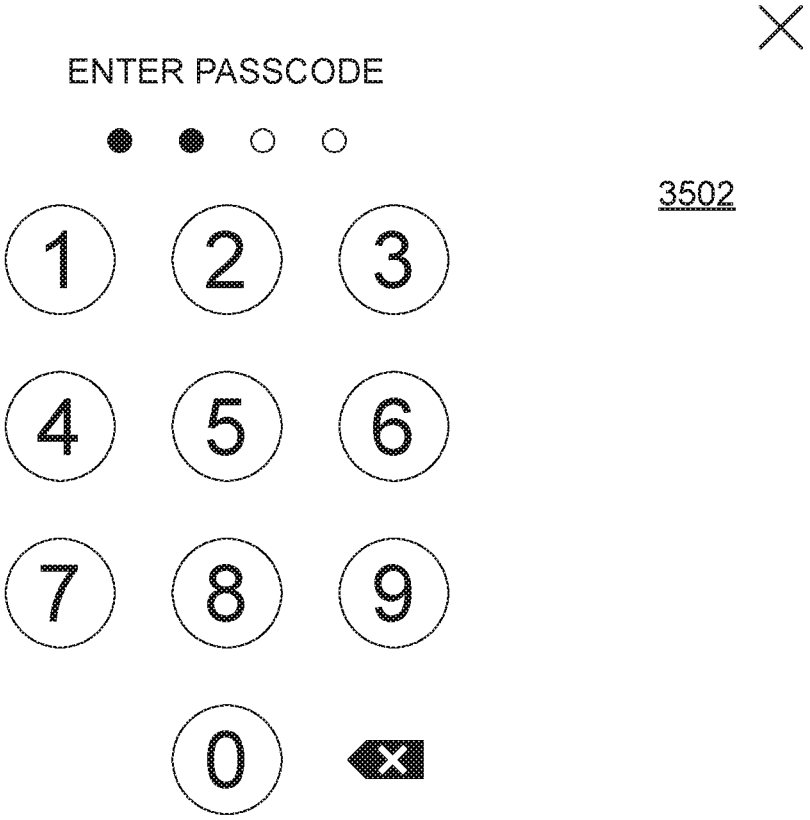
Figure 47:
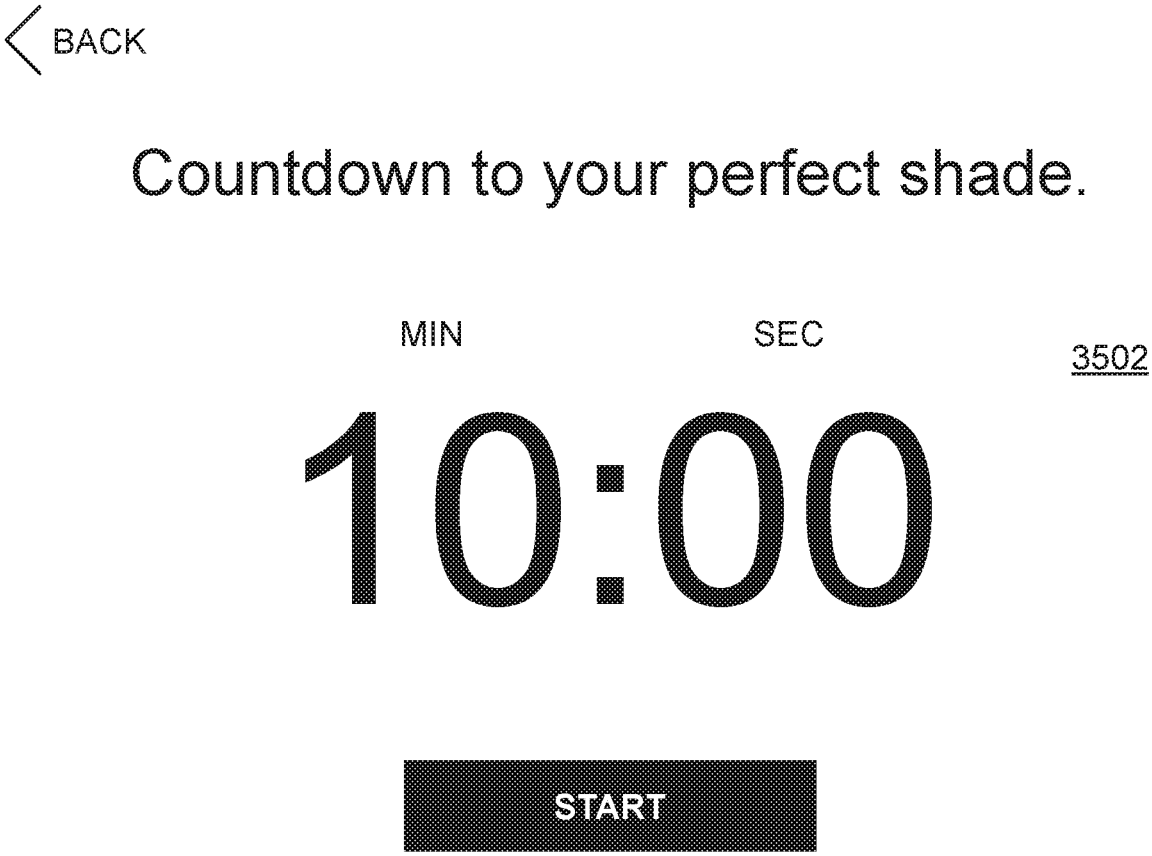

FIG. 43 depicts a panel for external inputs and/or outputs for the mixer unit 3500, according to an embodiment of the present disclosure. The panel may include an IEC socket 4502 for connecting power supply cords to the mixer unit 3500, a power switch 4504 for powering the mixer unit 3500 on or off, and one or more USB or Ethernet outlets 4506*a* . . . 4506*n* for connection to various devices for data input/output (e.g., printing, machine diagnostics, software update, etc.). All wiring external to the unit is removable for ease of transporting.

It should be appreciated that there may be stabilizing mechanisms or feet 122 underneath the units that may reduce vibration of the units. It should be appreciated that stabilizing mechanisms or feet 122 may be attached to each corner or edges of the units. Stabilizing mechanisms or feet 122 may also be used to level the units on any counter. It should be appreciated that a leveling system may be paired with or connected to sensors that may be provided at the base of dispenser unit 100 and may be monitored through an interface. An alternative embodiment is a tripod leveling system with one fixed tripod in the rear and two adjustable tripods in the front corners. It should also be appreciated that there may be an air control system for dust and odor migration. The system may provide negative air filtration for pulling air or odor through a charcoal filter and positive air filtration and may enable drawing air through a filter in order to keep dust out of the units.

FIGS. 44-47 show exemplary possibilities that may be displayed on the mixer interface 3502, according to embodiments of the present disclosure. For example, a password may be required to access the mixer unit 3500 as shown on FIG. 44. Mixer interface 3502 may also allow initiation of a blending process, for example, blending a sample from the dispenser unit 100 (e.g., such as the bottle 1402 and its contents shown in FIG. 28). Mixer interface 3502 may also allow user selection of the bottle size to be blended or mixed. In some embodiments, the mixer unit 3500 may be configured to automatically detect bottle size, for example, based on weight, visual cues, or other indicators. Mixer interface 3502 may also display blending progress on the screen. In an embodiment, the mixer interface 3502 may include an optional instructional video for using the mixer unit.

In some embodiments, the dispenser unit 100 may be configured to dispense a single dose sample onto a container, such as a glass plate. Mixer unit 3500 may also be configured to blend the single dose sample size. For example, the mixing assembly 3508 may be configured to "smash" or push another glass plate onto the glass plate holding the dispensed material, and the mixing assembly 3508 may rotate the two glass plates relative to each other to obtain uniform blending. The single dose can be used as a one day or single use supply, mound 0.5 gram-1 gram. In other embodiments, the dispenser unit and the mixer unit may be combined into a single machine without departing from the present disclosure.

Figure 48:
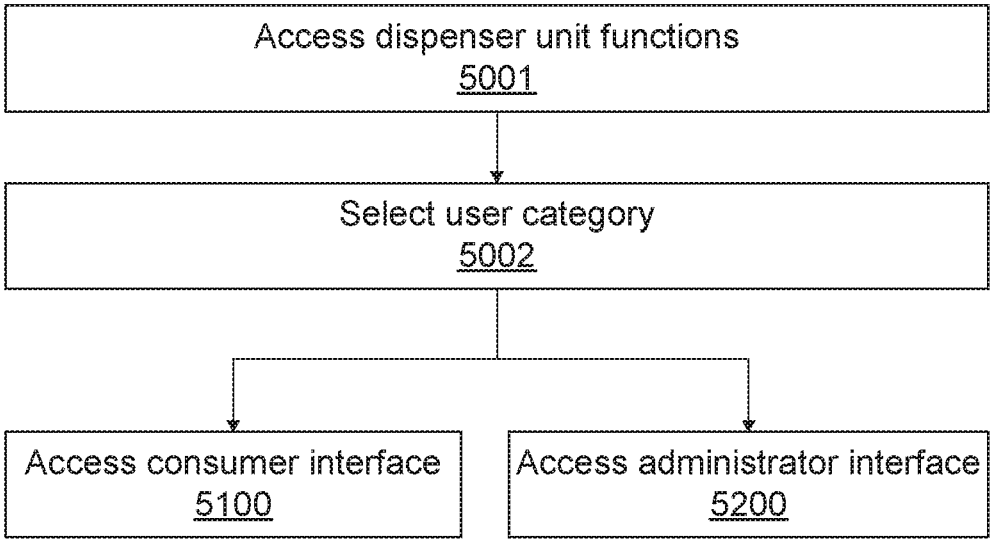
FIG. 48 depicts an exemplary method of initiating a dispenser unit, according to an embodiment herein.

FIG. 48 depicts an exemplary method for providing customizable products using the mixer and dispenser described herein, according to an embodiment of the present disclosure. At step 5001, the dispenser unit may be accessed by one or more users. A password or other authentication means (e.g., biometrics) may be implemented in order to access the dispenser unit's functions, according to an embodiment. At step 5002, the user can select a user category to access different user interfaces. For example, at a retail environment, the user may access a consumer interface at step 5100, or access an administrator (e.g., staff or employee) interface at step 5200.

Figure 49:
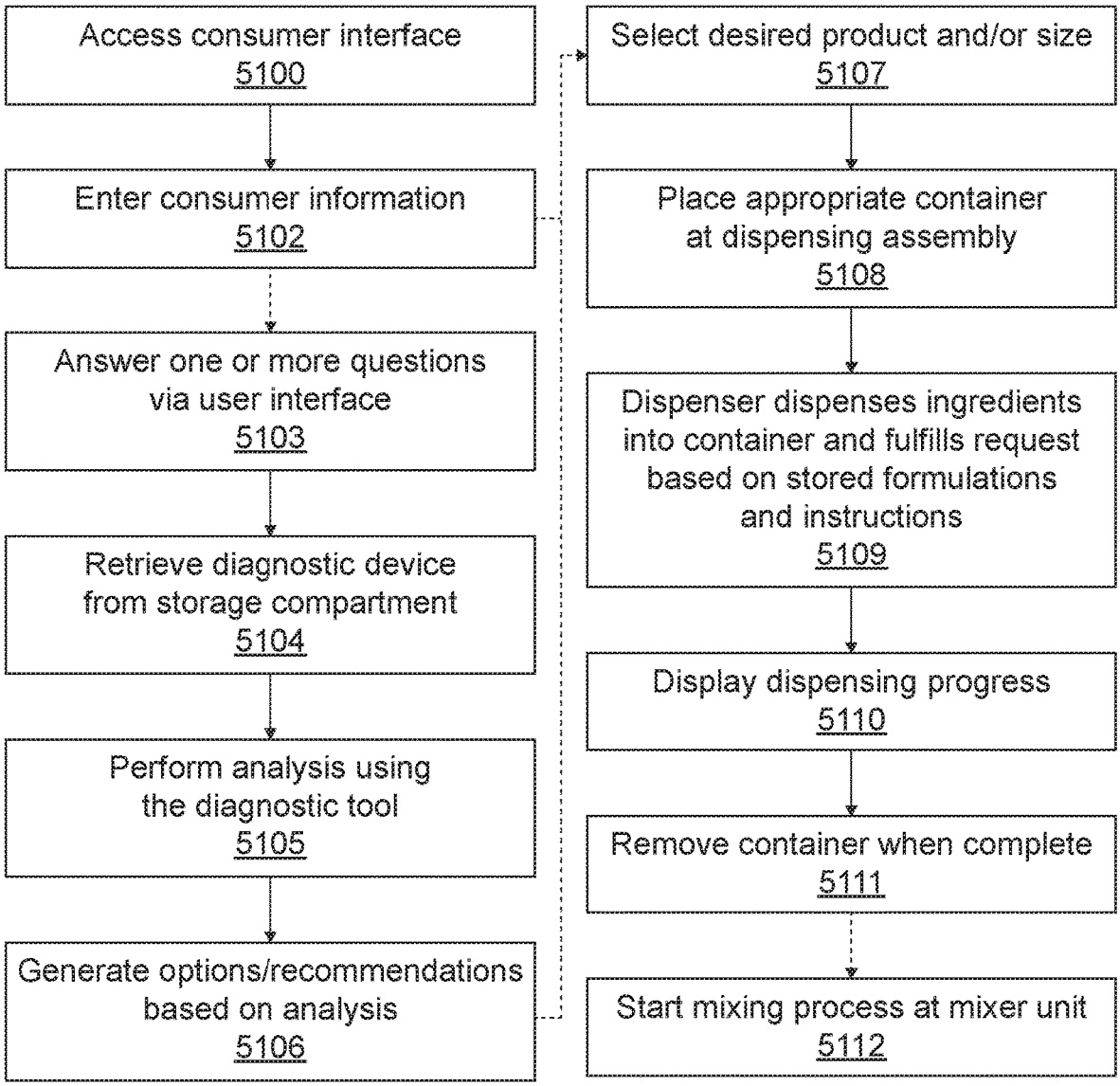
FIG. 49 depicts an exemplary process of using an administrator interface for the dispenser unit, according to an embodiment herein.

FIG. 49 depicts an exemplary method of providing the customizable products via a consumer interface, according to an embodiment of the present disclosure. After a consumer or user accesses the consumer interface at step 5100, the consumer may enter their consumer identifying information, such as name and contact information, at step 5102. The information entered may be used to create or update a user profile in one or more local or remote databases. For example, based on the information received from the consumer, user history can be retrieved from the one or more databases to determine if the user is a returning customer. If the user is a returning customer, the interface may skip to step 5107 and present an option for the user to select a product from previous purchase history and select the desired product and/or size. Alternatively, at step 5103, the interface may present one or more questions to the user to determine user characteristics and needs. For example, questions may be asked regarding user skin type, product desired, and other factors directed toward customizing the product. At step 5104, one or more diagnostic tools along with instructions shown on the interface may be used to diagnose the user. For example, the diagnostic tool may be a shade matching device such as that shown in FIG. 23 above, which is in communication with the dispenser unit via a wired or wireless network connection. At step 5105, an analysis can be performed based on the information obtained using the diagnostic tool. At step 5106, one or more recommendations/options can be generated and shown to the user based on the analysis (e.g., shade recommendations of FIG. 24). The user may then select a product and/or product size for the dispenser unit to fulfill at step 5107. At step 5108, based, on the selection, the appropriate container may be placed at the dispensing assembly automatically or by the user or salesperson. At step 5109, the dispenser can retrieve the appropriate "recipe" or formulation for the selected product/product size from the one or more databases and may dispense the materials from the materials stored at the one or more material packs into the container. At step 5110, the interface may show the progress and status of the user request. Once complete, the container may be removed from the dispenser at step 5111. Optionally, at step 5112, the container may be blended in a mixer such as mixer unit 3500 described above. In some embodiments, the apparatus may include both dispensing and mixing capabilities.

Figure 50:
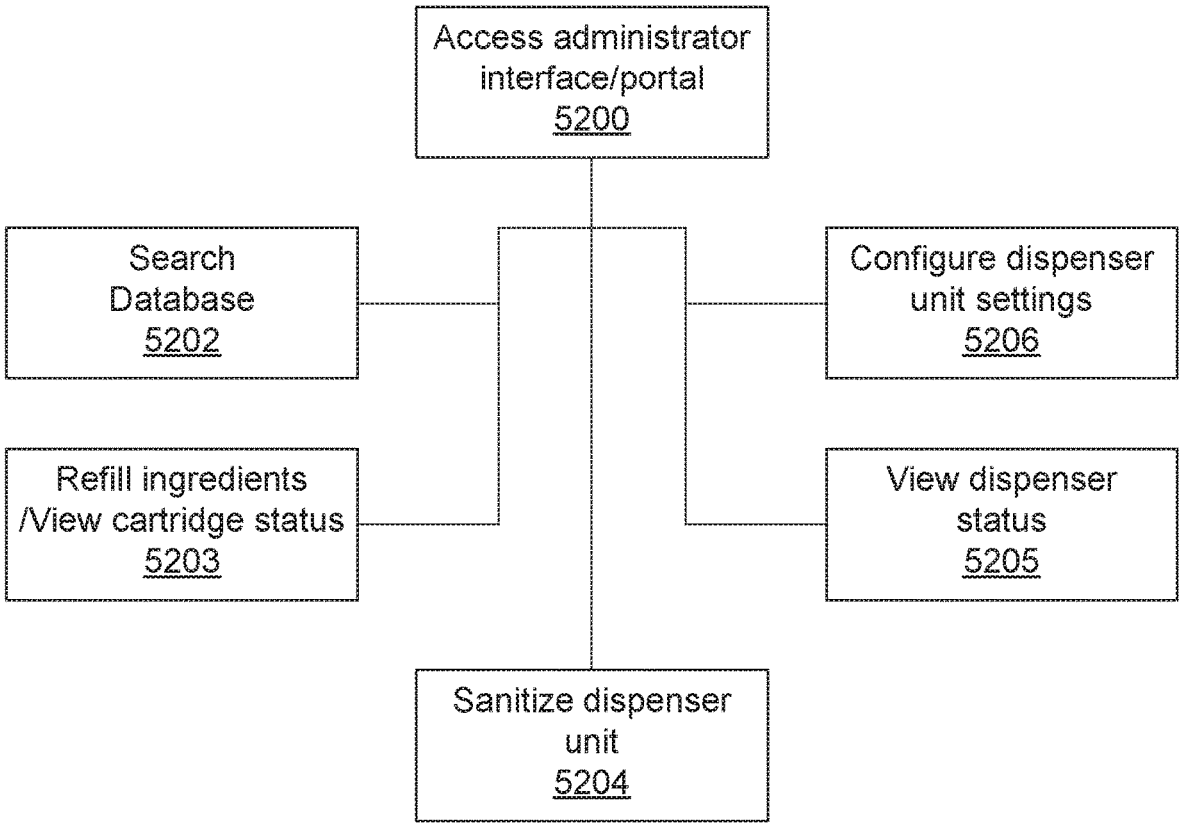
FIG. 50 depicts an exemplary process of dispensing a customizable composition at the dispenser unit, according to an embodiment herein.

FIG. 50 delineates the interaction with the interface for an administrator, according to an embodiment herein. Access to the administrator interface or portal may require authentication in certain embodiments. Once access to an administrator interface is granted at step 5200, the user can select perform various tasks related to the dispenser unit. For examples, the user can view or search one or more databases for customer or product information at step 5202. The user can also view status of material packs and initiate a refill process via the administrator portal at step 5203. The user can perform a sanitization procedure for the dispenser unit at step 5304. At step 5305, the user can also view the status of the dispenser unit, for example, the dispenser model information and statistics, user statistics, and other data. At step 5306, the user can view and adjust dispenser settings, such as motor speed, printer setup, connected devices, and other user-related information.

Figure 51:
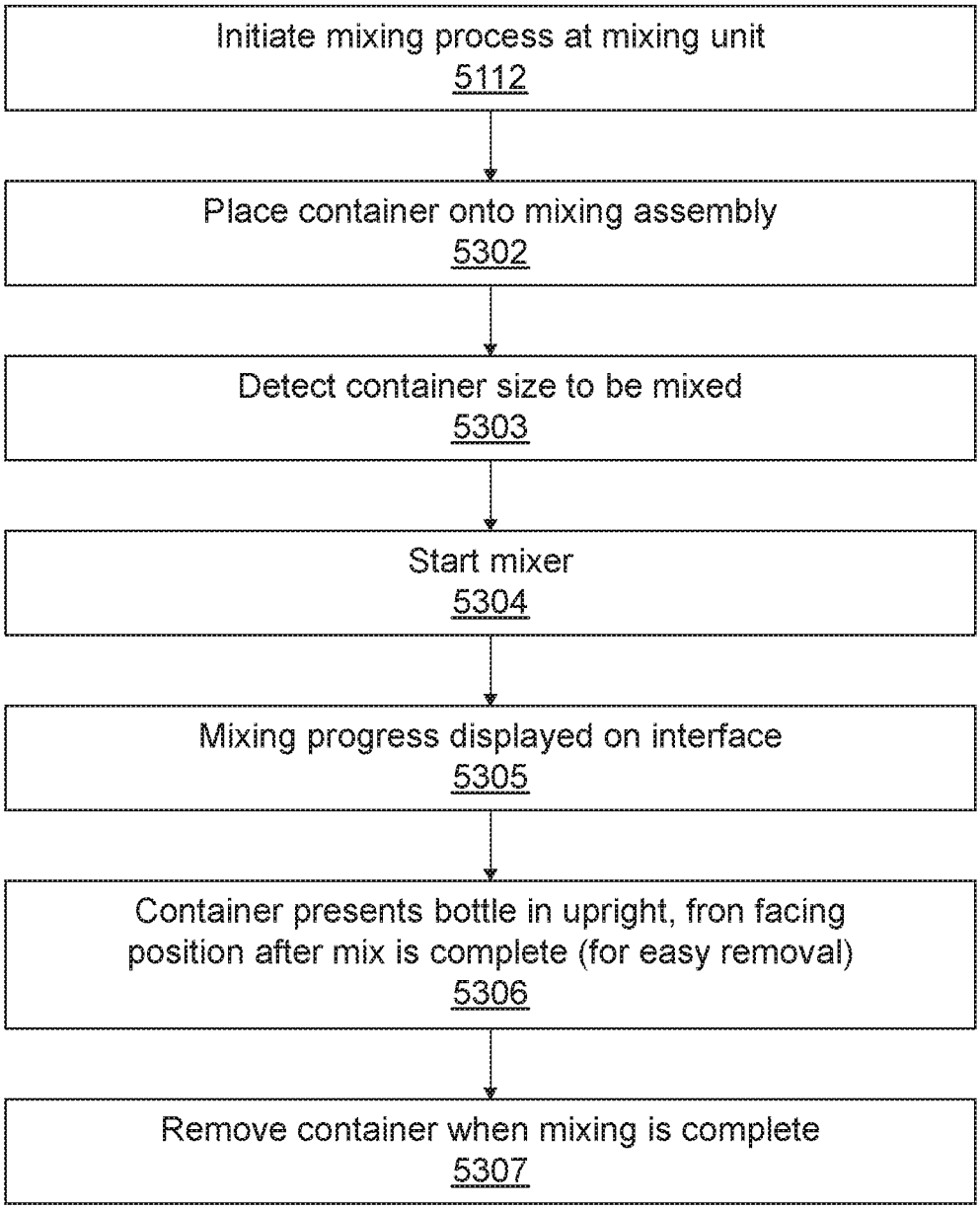
FIG. 51 depicts an exemplary process of mixing a composition at a mixer unit, according to an embodiment herein.

FIG. 51 depicts an exemplary method for mixing a composition at the mixer unit, accord to an embodiment herein. At step 5112, a mixing process may be initiated at a mixer unit (e.g., mixer unit 3500 described above). At step 5302, a container having a composition, such as a composition dispensed by the dispenser unit described herein, can be placed at the mixing assembly for blending. At step 5303, the container size can be automatically detected or obtained via user input. At step 5304, the mixing process begins. At steps 5305, the mixing progress may be displayed at the mixer interface. Once mixing is complete, the container may stop and present the bottle in an upright and front facing position for easy removal at step 5306 can be removed from the mixer at step 5307.

Figure 52:
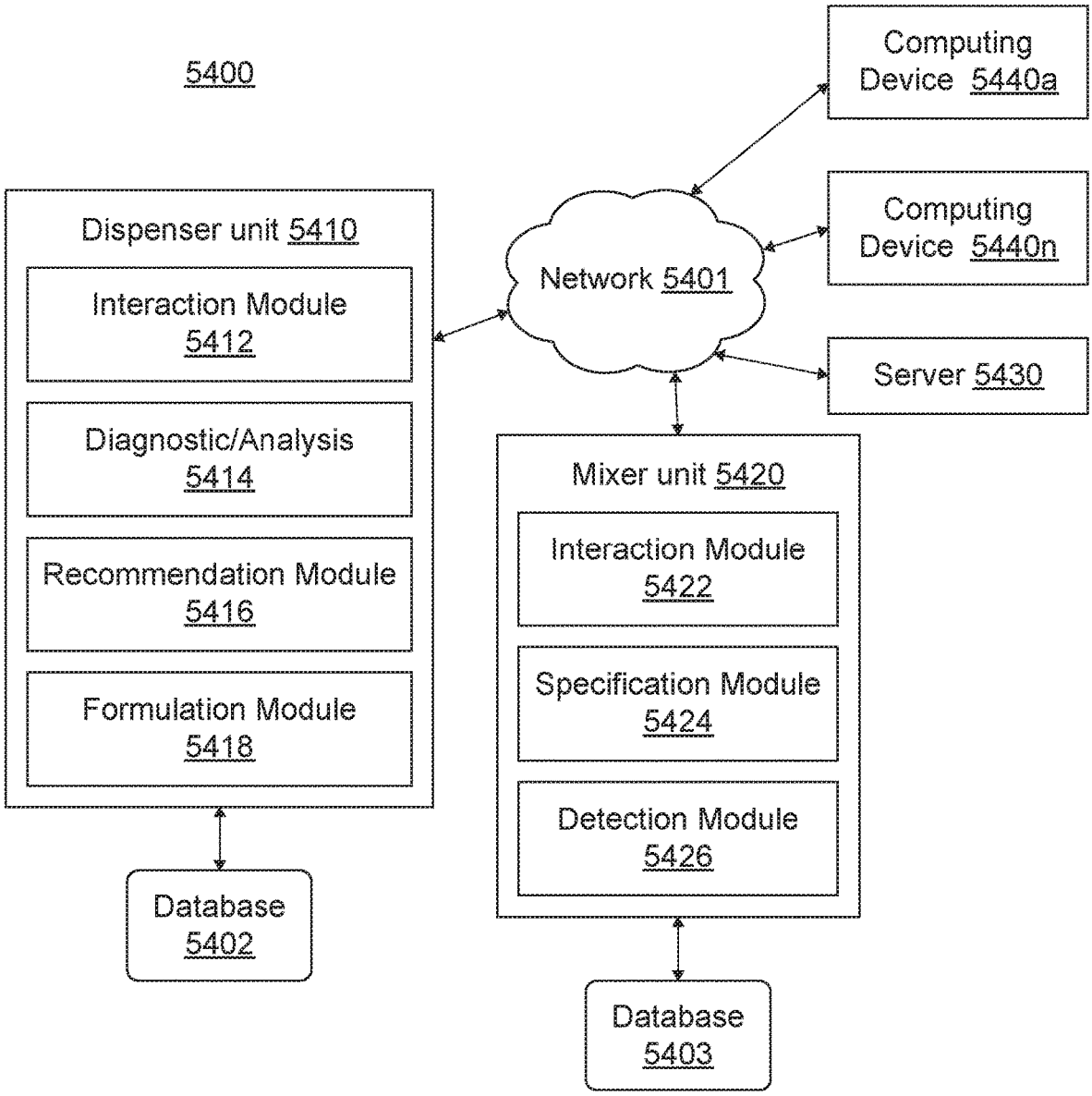
FIG. 52 depicts a system for providing custom blend compositions, according to an embodiment of the present disclosure.

FIG. 52 depicts an exemplary system for providing custom blend compositions, according to an embodiment of the present disclosure. System 5400 may include a dispenser unit 5410 coupled to a database 5402. Dispenser unit 5410 may be coupled to a mixer unit 5420, a server 5430, and one or more computing devices 5440*a* . . . 5440*n* over network 5401. Network 5401 may be a local area network (LAN), a wide area network (WAN) such as the Internet, a cellular data network, any combination thereof, or any combination of connections and protocols that will support communications between the dispenser unit 5410, mixer unit 5420, computing devices 5440*a* . . . 5410*n*, and databases 5402 and 5403, according to embodiments of the present disclosure. Network 5401 may include wired, wireless, or fiber optic connections. Dispenser unit 5410 (e.g., dispenser unit 100 described above) and/or mixer unit 5420 (e.g., mixer unit 3500 described above) may be in communication with one or more databases and/or one or more devices (e.g., printer, mixer unit, mobile device, etc.) to store and retrieve consumer information and/or product information/specifications. Server 5430 may be a management server, a web server, or any other electronic device or computing system capable of processing program instructions and receiving and sending data. Computing devices 5140*a* . . . 5440*n* may be a desktop computer, laptop computer, tablet computer, or other mobile devices. In general, computing device 5440*a* . . . 5440*n* may be any electronic device or computing system capable of processing program instructions, sending and receiving data, and communicating with one or more devices of system 5400 and server 5430 via network 5401.

Dispenser unit 5410 may include an interaction module 5412 configured to interact with different user groups. For example, the dispenser unit may be configured with one interface and may provide options for interacting with consumers, and the dispenser unit may be configured with a different interface that may provide options for interacting with staff/administrators. Dispenser unit 5410 may also include a diagnostic and/or diagnostic module/analysis module 5414 configured to perform a diagnosis and analysis of the user. For example, the dispenser unit 5410 may be configured to communicate with one or more external diagnostic tools to obtain user data, such as skin color/tone, skin type, and other user-related information. Based on the data obtained, the diagnostic module/analysis module 5414 may perform an analysis to categorize the results (e.g., skin type category, skin tone category, etc.). The dispenser unit 5410 may further include a recommendation module to determine best match(es) for the user (e.g., shade for foundation, moisturizer and/or skincare regimen) based on the results from the diagnostic/analysis module. The recommendations may be displayed on the user interface, sent to one or more external devices, and/or stored on one or more databases. If the user selects one or more of the products from the recommendations displayed, the dispenser unit's formulation module 5418 may retrieve formulation information for each product and determine proportion of each of the ingredients based on product size for the dispenser unit to fulfill.

Mixer unit 5420 may include an interaction module 5422 to interact with one or more users at the interface. Mixer unit 5420 may be configured with one interface and options for interacting with consumers, and/or the mixer unit 5420 may be configured with a different interface and options for interacting with staff/administrators. Mixer unit 5420 may also include a specification module 5424 configured to communicate with one or more databases database 5403) to obtain mixing specifications for one or more products. The mixing specifications may include, but are not limited to, pulse rate, mixing speed, mixing time, rotational parameters, and other specifications. Mixer unit 5420 may further include a detection module 5426 configured to obtain information related to the container including contents to be mixed. Information may be obtained via user entry at the interface by auto-detection using one or more mechanisms (e.g., weight, scanners, and other measurement devices), or other detection mechanisms.

Figure 53:
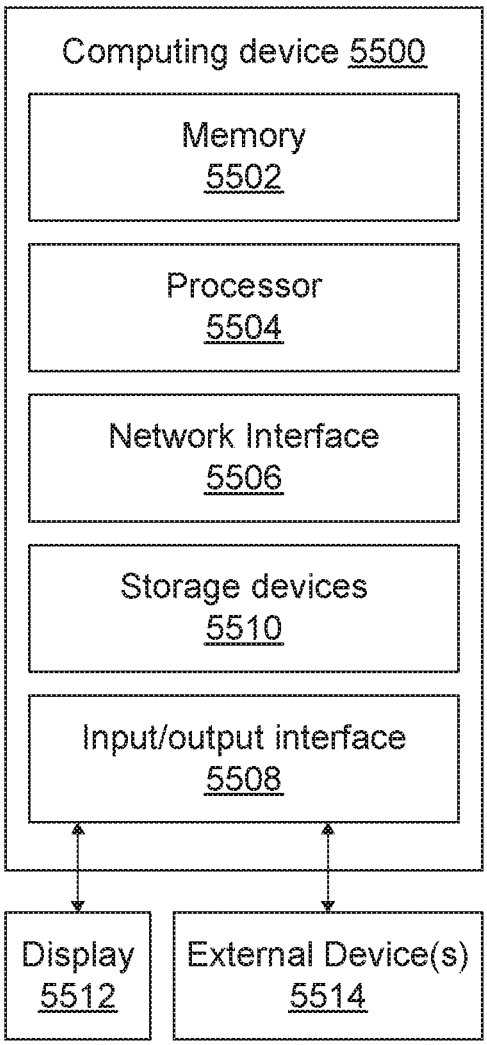
FIG. 53 depicts an exemplary computing device on which at least one car more components or steps of the present disclosure may be implemented, according to an embodiment of the present disclosure.

FIG. 53 depicts a block diagram of an exemplary computing device with which one or more steps/components of the present disclosure may be implemented, in accordance with an exemplary embodiment. Computing device 5500 includes one or more non-transitory computer-readable media for storing one or more computer-executable instructions or software for implementing exemplary embodiments. The non-transitory computer-readable media may include, but are not limited to, one or more types of hardware memory, non-transitory tangible media (for example, one or more magnetic storage disks, one or more optical disks, one or more flash drives, one or more solid state disks), and the like. For example, memory 5502 of the computing device 5500 may store computer-readable and computer-executable instructions or software (e.g., applications and modules described above) for implementing exemplary operations of the computing device 5500. Memory 5502 may include a computer system memory or random-access memory, such as DRAM, SRAM, EDO RAM, and the like. Memory 506 may include other types of memory as well, or combinations thereof. The computing device 5500 may also include configurable and/or programmable processor 5504 for executing computer-readable and computer-executable instructions or software stored in the memory 5502 and other programs for implementing exemplary embodiments of the present disclosure. Processor 5504 may be a single core processor or multiple core processor configured to execute one or more of the modules described in connection with dispenser unit 5410 and mixer unit 5420. Computing device 500 can receive data from input/output devices such as, external device 5514, display 5512, and computing devices 5540*a* . . . 5540*n*, via input/output interface 5508. A user may interact with the computing device 5500 through a display 5512, such as a computer monitor, which may display one or more graphical user interfaces, multi touch interface, etc. Input/output interface 5508 may provide a connection to external device(s) 5514 such as a keyboard, keypad, and portable computer-readable storage media such as, for example, thumb drives, portable optical or magnetic disks, and memory cards, etc. The computing device 5500 may also include one or more storage devices 5510, such as a hard-drive, CD-ROM, or other computer readable media, for storing data and computer-readable instructions and/or software that implement exemplary embodiments of the present disclosure (e.g., modules described above for the dispenser unit and mixer unit). The computing device 5500 can include a network interface 5506 configured to interface via one or more network devices with one or more networks, for example, Local Area Network (LAN), Wide Area Network (WAN) or the Internet through a variety of connections including, but not limited to, standard telephone lines, LAN or WAN links, broadband connections, wireless connections, controller area network (CAN), or some combination of any or all of the above.

The flowchart and block diagrams in the Figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

What is claimed is:

1. A cosmetic preparation system, comprising:

a dispenser unit arranged to dispense at least one ingredient into one or more containers, the dispenser unit comprising:

one or more packs, each pack having at least one of the ingredients therein;

a nozzle head that has one or more nozzles, and a nozzle limit switch that regulates the insertion of the one or more nozzles into the one or more containers;

one or more motorized pumps that control the movement of the ingredients from the one or more packs to the one or more nozzles;

wherein, the one or more motorized pumps are configurable to dispense the ingredients from the nozzles into the one or more containers at a rate of 1-4 mg per drop;

a diagnostic tool housed in a storage container, the diagnostic tool configured to automatically select and customize the at least one ingredient based on a user or user data; and a mixer unit having a mixing platform configured to mix the at least one ingredient inside the one or more containers, wherein the mixer unit provides gyroscopic mixing by means of two axial rotating elements and a stationary element, wherein each axial rotating element spins around its own central axis as it rotates about the stationary element.

2. The cosmetic preparation system of claim 1, wherein the dispenser unit is configured to alternate dispensing a first ingredient selected from the at least one ingredient, a second ingredient selected from the at least one ingredient, and additional ingredients selected from the at least one ingredient into the one or more containers.

3. The cosmetic preparation system of claim 1, wherein the diagnostic tool is a shade matching tool configured to customize the at least one ingredient to the user or the user data.

4. The cosmetic preparation system of claim 1, wherein the at least one ingredient is a formulation for a skincare treatment, a makeup product, a haircare product, a color extender, an active ingredient, a sunscreen, a fragrance, or a combination thereof.

5. The cosmetic preparation system of claim 1, wherein the at least one ingredient is a formulation customized for application to keratinous surfaces.

6. The cosmetic preparation system of claim 1, wherein the dispenser unit is capable of housing the one or more containers with various shapes and sizes.

7. The cosmetic preparation system of claim 1, wherein the diagnostic tool is a shade matching tool.

8. The cosmetic preparation system of claim 7, wherein the shade matching tool automatically measures skin characteristics and diagnoses undertones including oil, moisture, skin sensitivity, cleanliness, fatigue, irritation, other skin characteristics, and combinations thereof.

* * * * *